US010711523B2

(12) United States Patent
Taggart et al.

(10) Patent No.: US 10,711,523 B2
(45) **Date of Patent: *Jul. 14, 2020**

(54) AUTOMATED DRILLING/SERVICE RIG APPARATUS

(71) Applicant: PROSTAR ENERGY TECHNOLOGIES (USA) LLC, Leduc (CA)

(72) Inventors: Mark Charles Taggart, High River (CA); Douglas Andrew Hunter, Calgary (CA); Daniel Harvard Kusler, De Winton (CA); Colin Reynold Knapp, Calgary (CA)

(73) Assignee: PROSTAR ENERGY TECHNOLOGIES (USA) LLC, Leduc (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/706,199

(22) Filed: Sep. 15, 2017

(65) Prior Publication Data

US 2018/0023346 A1 Jan. 25, 2018

Related U.S. Application Data

(63) Continuation of application No. 14/576,420, filed on Dec. 19, 2014, now Pat. No. 9,797,196.

(60) Provisional application No. 61/918,123, filed on Dec. 19, 2013.

(51) Int. Cl.

| | |
|---|---|
| ***E21B 7/02*** | (2006.01) |
| ***E21B 15/00*** | (2006.01) |
| ***E21B 19/083*** | (2006.01) |

(52) U.S. Cl.

CPC ..... *E21B 7/023* (2013.01); *E21B 7/022* (2013.01); *E21B 15/00* (2013.01); *E21B 19/083* (2013.01)

(58) Field of Classification Search

CPC ..... E21B 7/023; E21B 7/022

See application file for complete search history.

(56) References Cited

U.S. PATENT DOCUMENTS

| | | | | |
|---|---|---|---|---|
| 1,427,642 | A | 8/1922 | Rickard | |
| 3,034,660 | A * | 5/1962 | Rau | B66C 23/344 212/299 |
| 3,084,806 | A * | 4/1963 | Staples | B66C 23/344 212/295 |
| 3,295,270 | A | 1/1967 | Woolslayer et al. | |
| 4,371,046 | A | 2/1983 | Read | |

(Continued)

*Primary Examiner* — Taras P Bemko

(74) *Attorney, Agent, or Firm* — Bennett Jones LLP

(57) ABSTRACT

An automated rig apparatus for drilling or servicing a well is provided. The apparatus can include a motor vehicle having a frame, and a hinged derrick mast pivotally attached to the frame. The apparatus can further include a rack disposed in the mast and a carriage assembly with pinion motors configured to travel up and down the rack when the mast is raised to a vertical position. A tool carrier configured to receive a top drive unit or a power swivel unit can be attached to the carriage assembly. The apparatus can further include a movable platform and an operators cab configured to be moved to a desired position relative to the derrick mast when the mast is raised to a vertical position. The apparatus can further include a hydraulic drive assembly to operate the apparatus, and a mud pump and manifold for pumping drilling mud.

42 Claims, 22 Drawing Sheets

(56) References Cited

U.S. PATENT DOCUMENTS

| | | | | |
|---|---|---|---|---|
| 4,393,630 | A | 7/1983 | Knox | |
| 5,016,768 | A * | 5/1991 | Kennard, Jr. | B66C 23/344 212/262 |
| 5,094,302 | A | 3/1992 | Back | |
| 5,794,723 | A | 8/1998 | Caneer, Jr. et al. | |
| 6,216,789 | B1 * | 4/2001 | Lorsignol | B66D 1/505 166/355 |
| 6,224,037 | B1 | 5/2001 | Novick | |
| 6,336,622 | B1 | 1/2002 | Eilertsen et al. | |
| 2007/0108427 | A1 * | 5/2007 | Smith | B66F 11/00 254/266 |
| 2009/0008615 | A1 | 1/2009 | Young et al. | |
| 2010/0193247 | A1 | 8/2010 | Riddle et al. | |
| 2011/0221215 | A1 * | 9/2011 | Botwright | B66C 1/108 294/81.4 |
| 2012/0130537 | A1 | 5/2012 | Gerber | |
| 2013/0299190 | A1 | 11/2013 | Reddy et al. | |
| 2013/0341004 | A1 | 12/2013 | Flusche | |
| 2014/0262518 | A1 | 9/2014 | Reddy et al. | |
| 2016/0060893 | A1 * | 3/2016 | Roodenburg | E21B 7/02 52/123.1 |

* cited by examiner 34
92
22
33

32
82
82
27
80
80
38
33
36
40
42
30
44
80
33
46

11
58
12
10
84
19
1
60
9
15
14

16
17
18
34
22
6
28
24
25
29
26
28
20
32
36
30

AUTOMATED DRILLING/SERVICE RIG APPARATUS

CROSS-REFERENCE TO RELATED APPLICATIONS

This application is a continuation of U.S. application Ser. No. 14/576,420 filed Dec. 19, 2014 which is presently and which claims benefit of U.S. provisional patent application Ser. No. 61/918,123 filed Dec. 19, 2013.

TECHNICAL FIELD

The present disclosure is related to the field of service rigs for use on a well, in particular, automated hydraulic and/or electric-powered drilling rigs or service rigs for the drilling or servicing of wells.

BACKGROUND

In drilling a well, a drill string is used. The drill string can comprise a drill bit attached to sections of drill pipe. As the well is drilled, additional sections of drill pipe are added to the drill string until the well is drilled deep enough to reach a formation where substances, such as water, oil or gas, can be produced from the well. Some wells require both a vertical section and a horizontal section. Sections of pipe are joined together using threaded connections on the pipe. The drill string is rotated to turn the drill bit in order to drill the well. When the drill string is removed from the wellbore, the sections of pipe can be removed from the drill string one or more sections at a time.

To drill or service wells, known designs use a drawworks with a transmission to operate the block mechanism to raise and lower the drill string into the hole. When raising a drill string, the drawworks is driven from an electric, hydraulic or mechanical means to wind a cable around a drum pulling the blocks and string towards the crown. When lowering a drill string, the combined weight of the string and block assembly causes the string to be lowered into the hole. This process of lowering the string into the hole can cause the string to become stuck on long horizontal well applications. This is time consuming, and can substantially increase the time required to service a horizontal well, thus requiring additional equipment the complete the service operation of that well.

It is, therefore, desirable to provide an automated service rig that overcomes the shortcomings of the prior art and decrease the time required to drill and/or service wells.

SUMMARY

Broadly stated, in some embodiments, a rig apparatus can be provided for drilling or servicing a well, the apparatus comprising: a substructure comprising a frame; a derrick mast comprising a lower mast section pivotally attached to the frame and an upper mast section pivotally attached to the lower mast section, the derrick mast configured to move from a lowered substantially horizontal position relative to the frame, wherein the upper mast section is folded against the lower mast section, to a raised substantially vertical position relative to the frame, wherein the upper mast section is pivoted relative to the lower mast section until the upper and lower mast sections are substantially axially aligned to form the derrick mast; a rack assembly disposed in the derrick mast; a carriage assembly configured to travel up and down the derrick mast along the rack assembly, the carriage assembly further configured to receive a tool; a platform configured to move to a first predetermined position relative to the derrick mast when the derrick mast is moved to the substantially vertical position; and a hydraulic drive assembly configured to provide hydraulic power for the apparatus.

Broadly stated, in some embodiments, the substructure can further comprise a an upper rack section disposed in the upper mast section and a lower rack section disposed in the lower mast section, the upper and lower rack sections configured for coupling to each other when the derrick mast is in the substantially vertical position.

Broadly stated, in some embodiments, the rack assembly can further comprise a first load cell operatively disposed between an upper end of the rack assembly and an upper end of the derrick mast, the load cell configured to measure pull force.

Broadly stated, in some embodiments, the rig apparatus can further comprise a first hydraulic cylinder for pivotally raising and lowering the lower mast section relative to the frame.

Broadly stated, in some embodiments, the rig apparatus can further comprise at least one second hydraulic cylinder for pivoting the upper mast section relative to the lower mast section.

Broadly stated, in some embodiments, the rig apparatus can further comprise a third hydraulic cylinder disposed between the frame and the rack assembly, the third hydraulic cylinder configured to tension the rack assembly when the derrick mast is in the substantially vertical position.

Broadly stated, in some embodiments, the rig apparatus can further comprise a pressure transducer or load pin operatively connected to the third hydraulic cylinder, the pressure transducer configured to measure push force.

Broadly stated, in some embodiments, the carriage assembly can further comprise a plurality of trolley wheels configured to travel along tracks or guides disposed along the upper and lower mast sections.

Broadly stated, in some embodiments, the carriage assembly can further comprise a plurality of pinion motors configured to engage the rack assembly wherein operation of the pinion motors cause the carriage assembly to travel along the rack assembly.

Broadly stated, in some embodiments, the pinion motors can be disposed on the carriage assembly in two vertical columns and can be further configured to engage the rack assembly on opposing sides of the rack assembly.

Broadly stated, in some embodiments, each pinion motor can comprise a pinion gear and each opposing side of the rack assembly can comprise teeth disposed thereon, wherein the teeth can be configured to engage the pinion gears.

Broadly stated, in some embodiments, the teeth disposed on one of the opposing sides of the rack assembly can be offset from the teeth disposed on the other of the opposing sides of the rack assembly.

Broadly stated, in some embodiments, the pinion motors can comprise wheels operatively disposed on the rear of the pinion gears to maintain proper gear tooth engagement during operation.

Broadly stated, in some embodiments, the tool can comprise at least one of a group consisting of a top drive, a power swivel, a coil tubing injector, a continuous rod injector, a pipe gripper, push slips, a wobble drive, a rotating pipe handler, links and elevators, or other tools as well known to those skilled in the art.

Broadly stated, in some embodiments, the hydraulic drive assembly can further comprise a hydraulic drive motor, a hydraulic fluid pump, a hydraulic tank, a supply of hydraulic fluid and at least one hydraulic fluid control valve for controlling the flow of hydraulic fluid.

Broadly stated, in some embodiments, the apparatus can further comprise a mud pump system, further comprising a mud pump, a mud pump motor and a mud pump manifold.

Broadly stated, in some embodiments, the apparatus can further comprise a programmable logic controller configured to control the hydraulic drive assembly.

Broadly stated, in some embodiments, the apparatus can further comprise at least one tugger winch disposed on a top surface or crown disposed on the upper mast section.

Broadly stated, in some embodiments, the substructure can comprise one or both of a motor vehicle and a rig mat.

Broadly stated, in some embodiments, the apparatus can further comprise an operators cab configured to move from a first predetermined position to a second predetermined position relative to the platform when the derrick mast is moved to the substantially vertical position.

Broadly stated, in some embodiments, a method for drilling or servicing a well is provided, the method comprising the steps of: providing a rig apparatus as described above; raising the derrick mast to the substantially vertical position; moving the platform to the first predetermined position; placing the tool on the carriage assembly; and drilling or servicing the well.

Broadly stated, in some embodiments, the method can further comprise the steps of positioning a rig mat adjacent to the well; and placing the apparatus on the rig mat.

Broadly stated, in some embodiments, the step of raising the derrick mast to the substantially vertical position can further comprise the steps of: first raising the lower mast section from the substantially horizontal position to the substantially vertical position, wherein the upper mast section is folded against the lower mast section; and then pivoting the upper mast section relative to the lower mast section until the upper and lower mast sections are substantially axially aligned to form the derrick mast.

Broadly stated, in some embodiments, the method can further comprise the step of moving the operators cab to the second predetermined position.

DETAILED DESCRIPTION OF EMBODIMENTS

Figures 1, 2, 3:
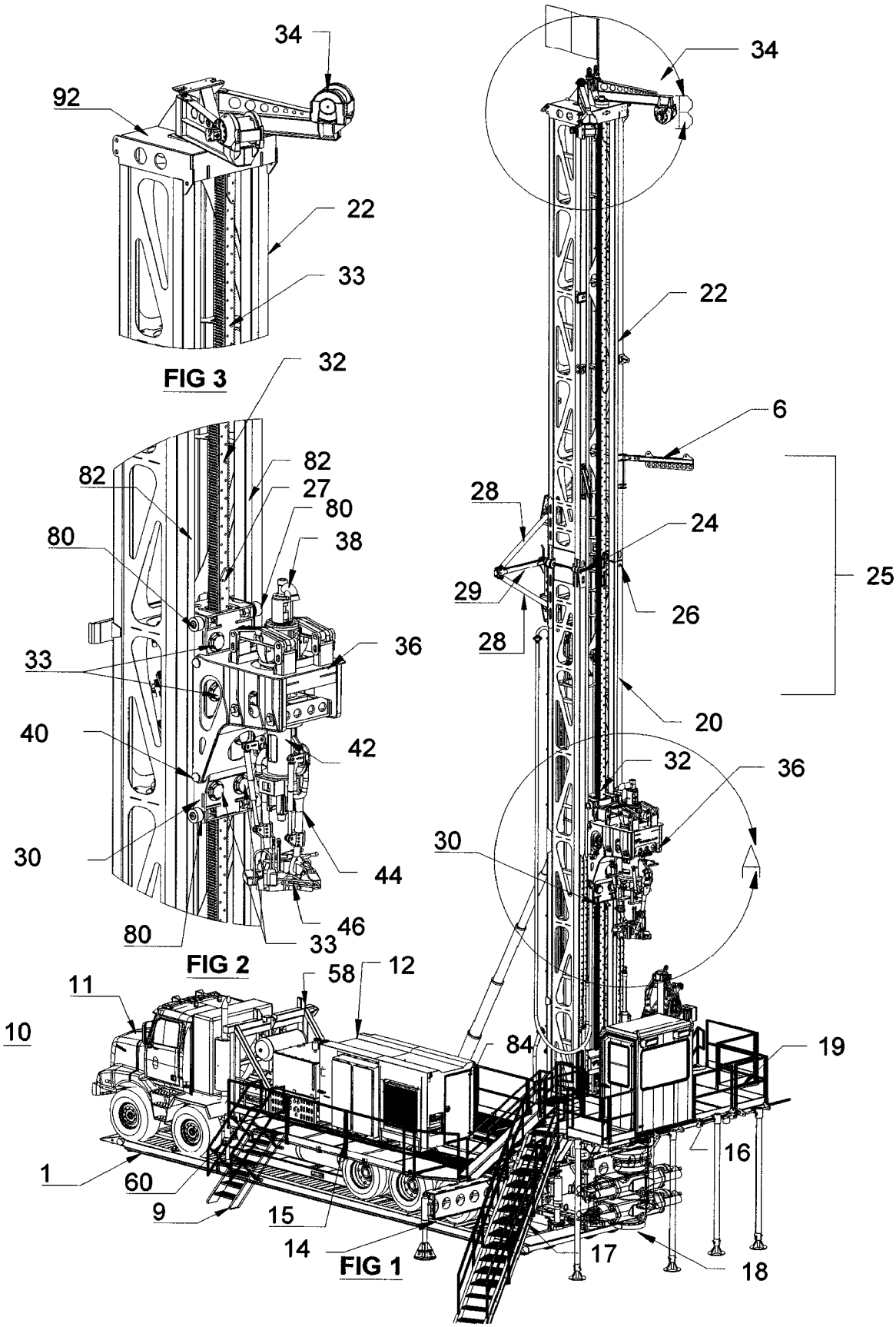
FIG. 1 is a left rear perspective view depicting one embodiment of an automated rig apparatus with a derrick mast in a raised position.
FIG. 2 is a left rear perspective view depicting a carriage assembly of the rig apparatus as shown in detail A of FIG. 1.
FIG. 3 is a left rear perspective view depicting the upper end of the derrick mast of the rig apparatus as shown in detail B of FIG. 1.
Figures 4, 5, 6:
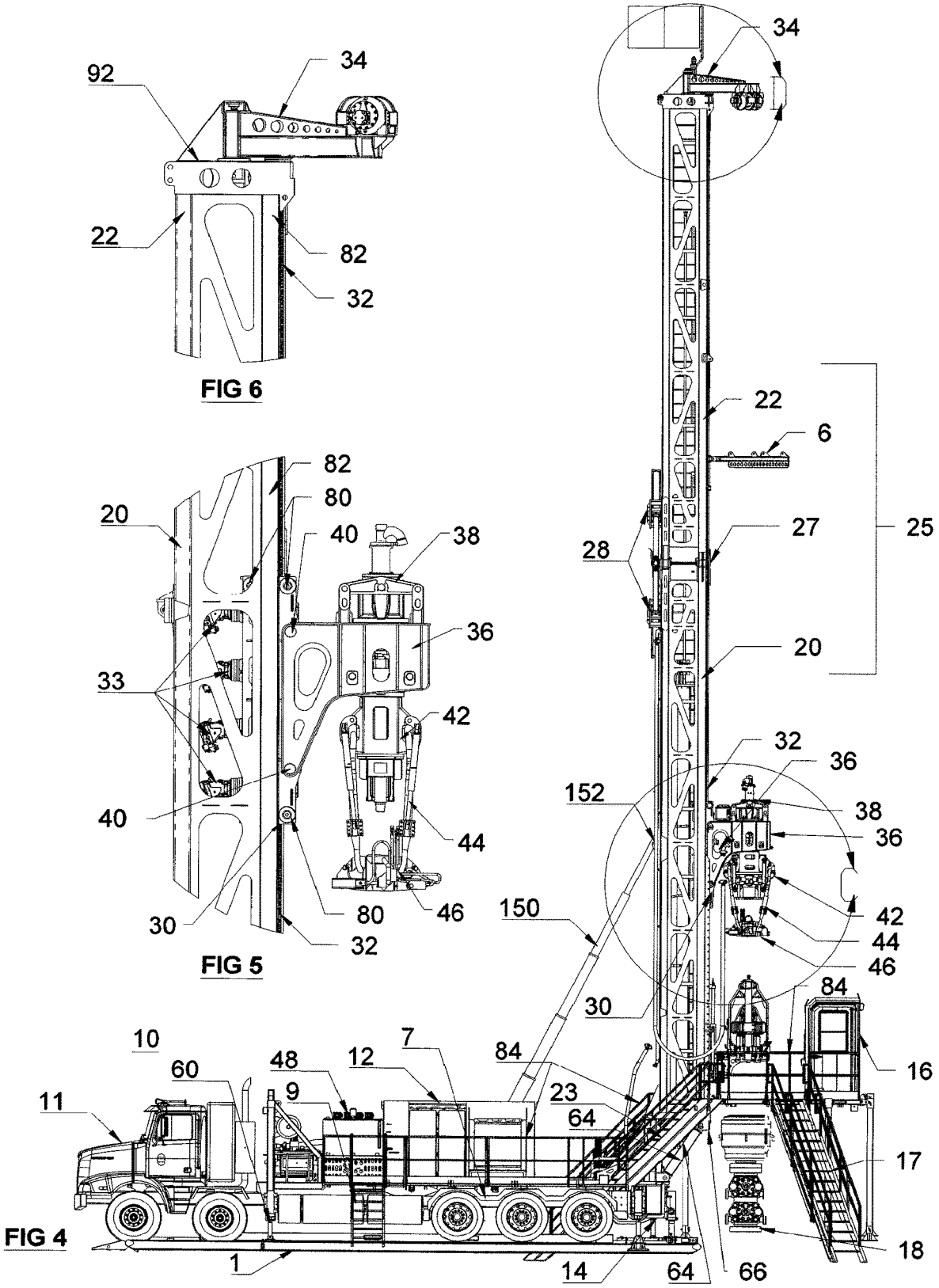
FIG. 4 is a left side elevation view depicting the rig apparatus of FIG. 1.
FIG. 5 is a left side elevation view depicting the carriage assembly of the rig apparatus as shown in detail C of FIG. 4.
FIG. 6 is a left side elevation view depicting the tugger winches of the apparatus as shown in detail D of FIG. 4.
Figure 8:
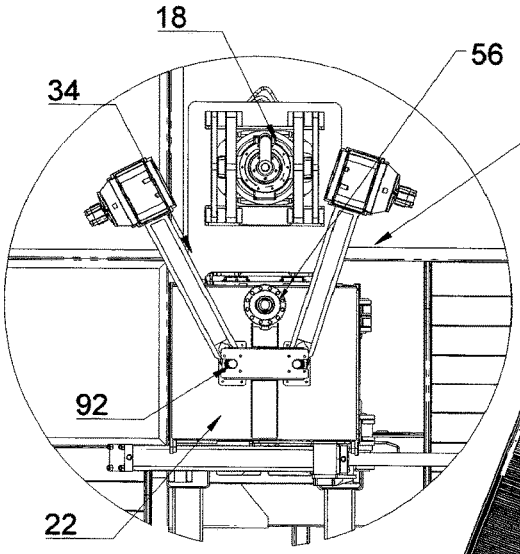
FIG. 8 is a top plan view depicting the derrick mast of the rig apparatus as shown in detail E of FIG. 7.

An automated rig apparatus for drilling or servicing a well is provided. Referring to FIGS. 1 to 16, one embodiment of rig apparatus 10 is shown. In some embodiments, rig apparatus 10 can comprise a substructure comprising frame 7, and can further comprise rig mat 9. Rig mat 9 can comprise a rig mat system as well known to those skilled in the art. In some embodiments, the substructure can further comprise a motor vehicle, as represented by truck 11 shown in FIG. 1. Truck 11 can comprise a heavy duty tractor such as those used in a tractor-trailer unit, as well known to those skilled in the art. In some embodiments, rig apparatus 10 can be driven to a well location, either to drill a well or to service an existing well, shown as blow-out preventer ("BOP") 18 in the Figures. In some embodiments, rig apparatus 10 can comprise hydraulic drive assembly 12 disposed on frame 7, rear outriggers 14 and front outriggers 60 for stabilizing rig apparatus 10 on rig mat 1 and subsequently to the ground surrounding a well site. Rear and front outriggers 14 and 60 can comprise hydraulic cylinders disposed therein to extend the outriggers out in a working position for stabilizing rig apparatus 10 at a drill site, and to retract the outriggers in a transport position when rig apparatus is being moved to a well site.

Figure 17:
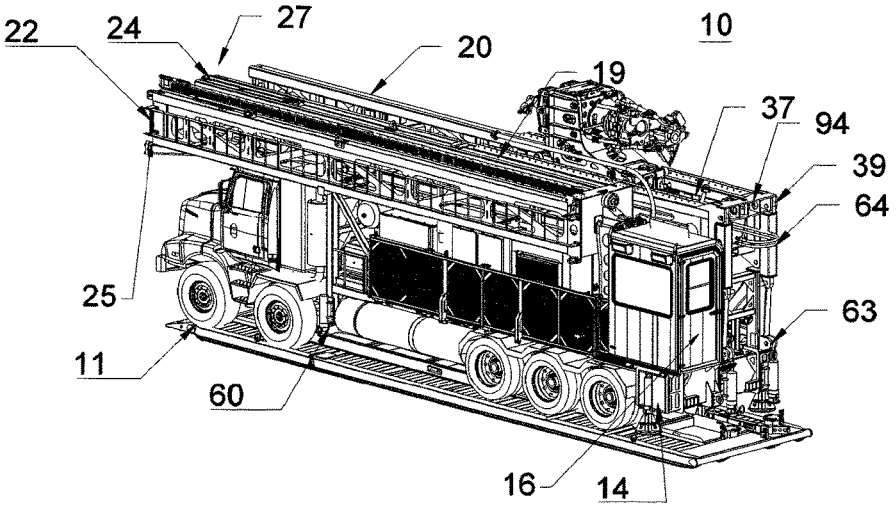
FIG. 17 is a left rear perspective view depicting the rig apparatus of FIG. 1 with the derrick mast in a lowered position for transport.

In some embodiments, rig apparatus 10 can comprise platform 19 configured to move from a transport position to a working position disposed above BOP 18, such as shown in FIG. 1. Rig apparatus 10 can further comprise operators cab 16 configured to move from a transport position to a working position adjacent platform 19. In some embodiments, cab 16 can comprise two halves that can telescope or move relative to one another such that the halves can be nested together for transport, as shown in FIG. 17, and then expanded, as shown in FIG. 1, when in the working position.

Figure 7:
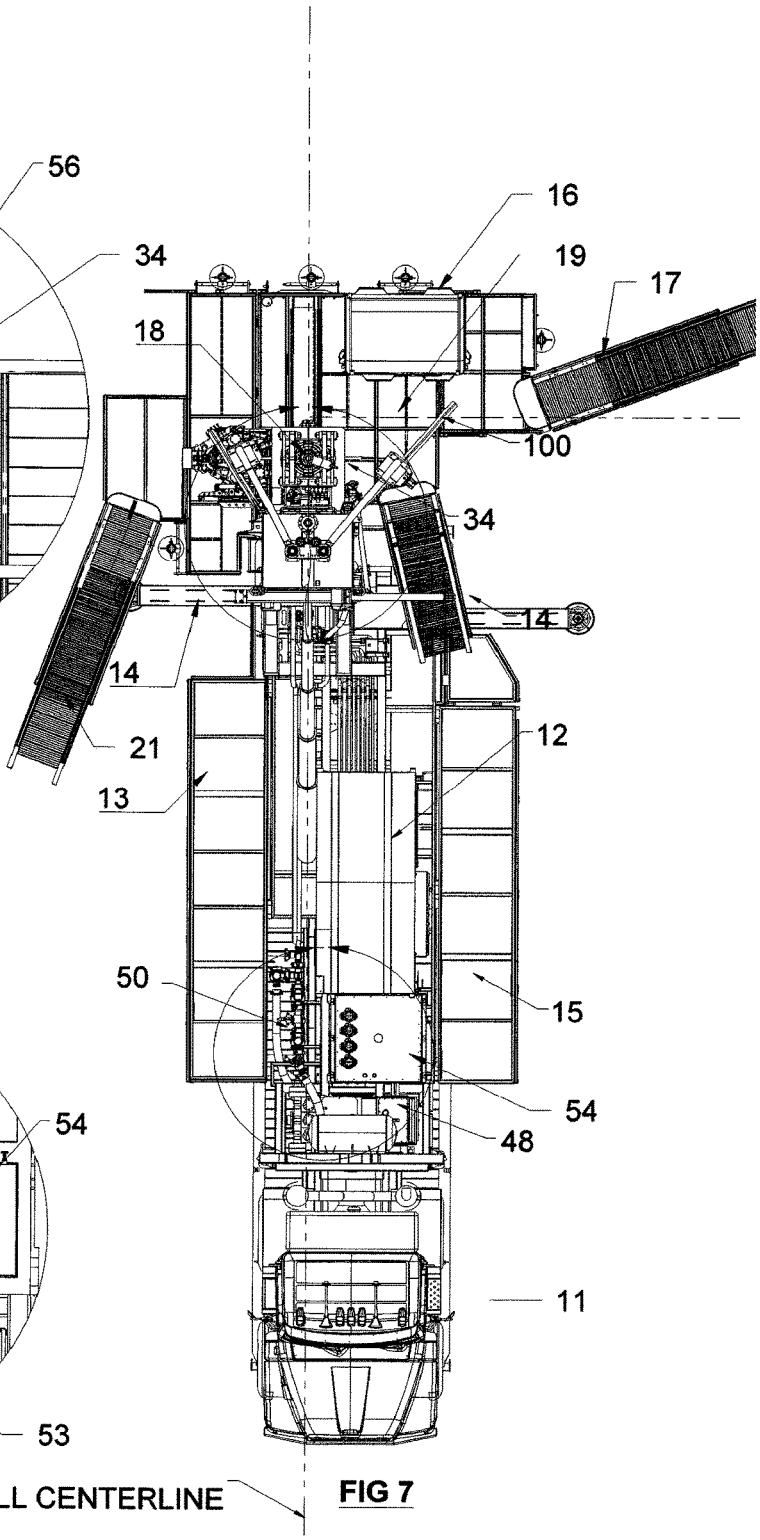
FIG. 7 is a top plan view depicting the rig apparatus of FIG. 1.
Figure 9:
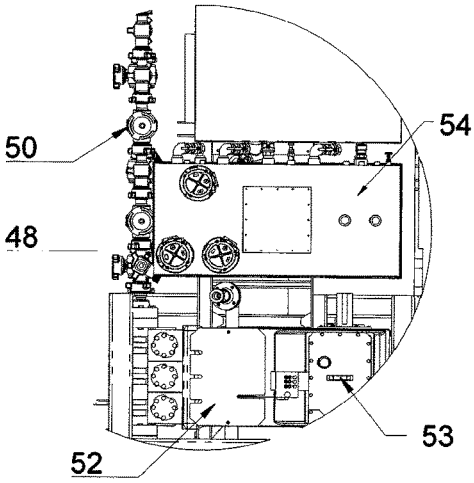
FIG. 9 is a top plan view depicting the hydraulic tank and the mud pump and manifold of the rig apparatus as shown in detail F of FIG. 7.
Figure 10:
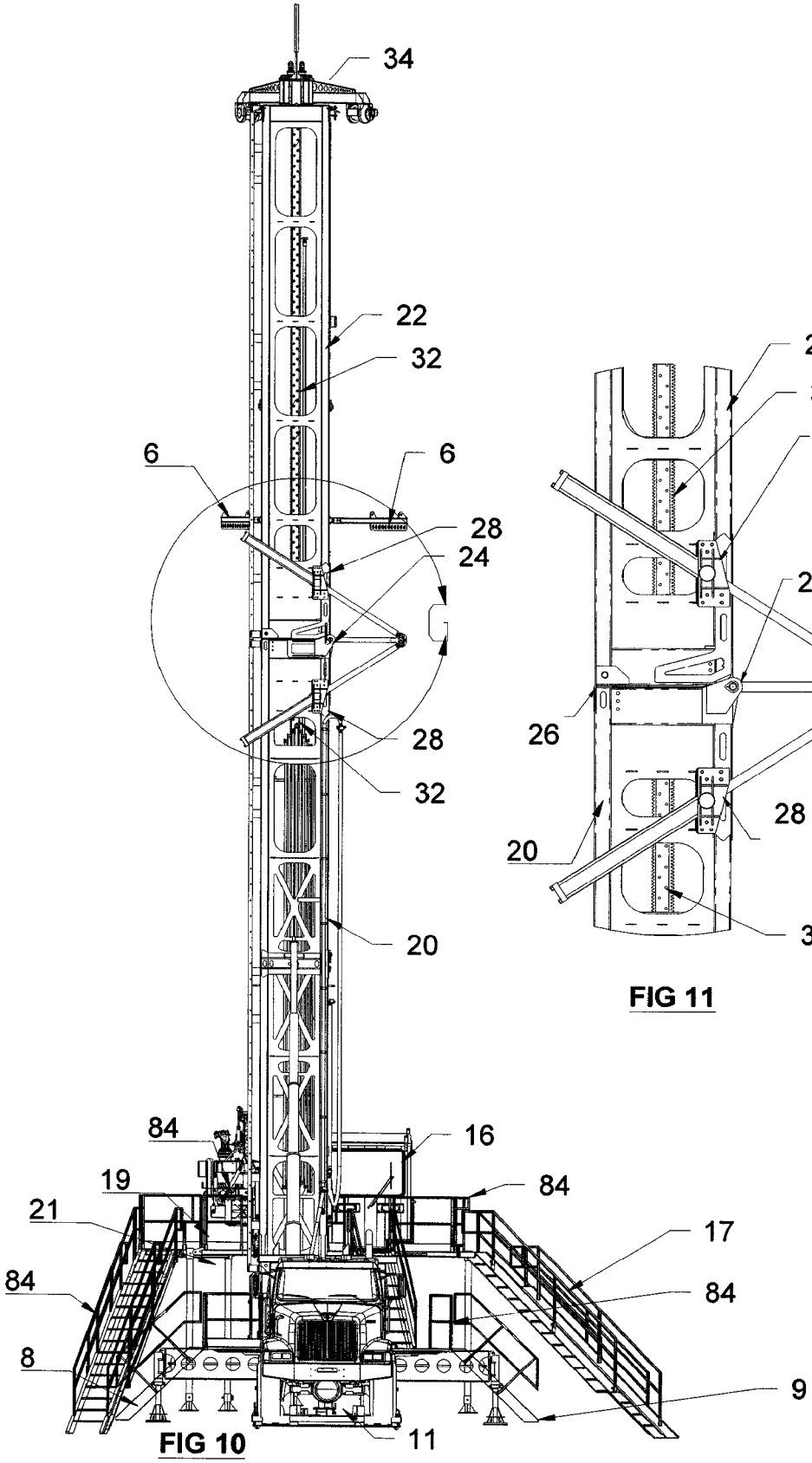
FIG. 10 is a front elevation view depicting the rig apparatus of FIG. 1.
Figures 14, 15, 16:
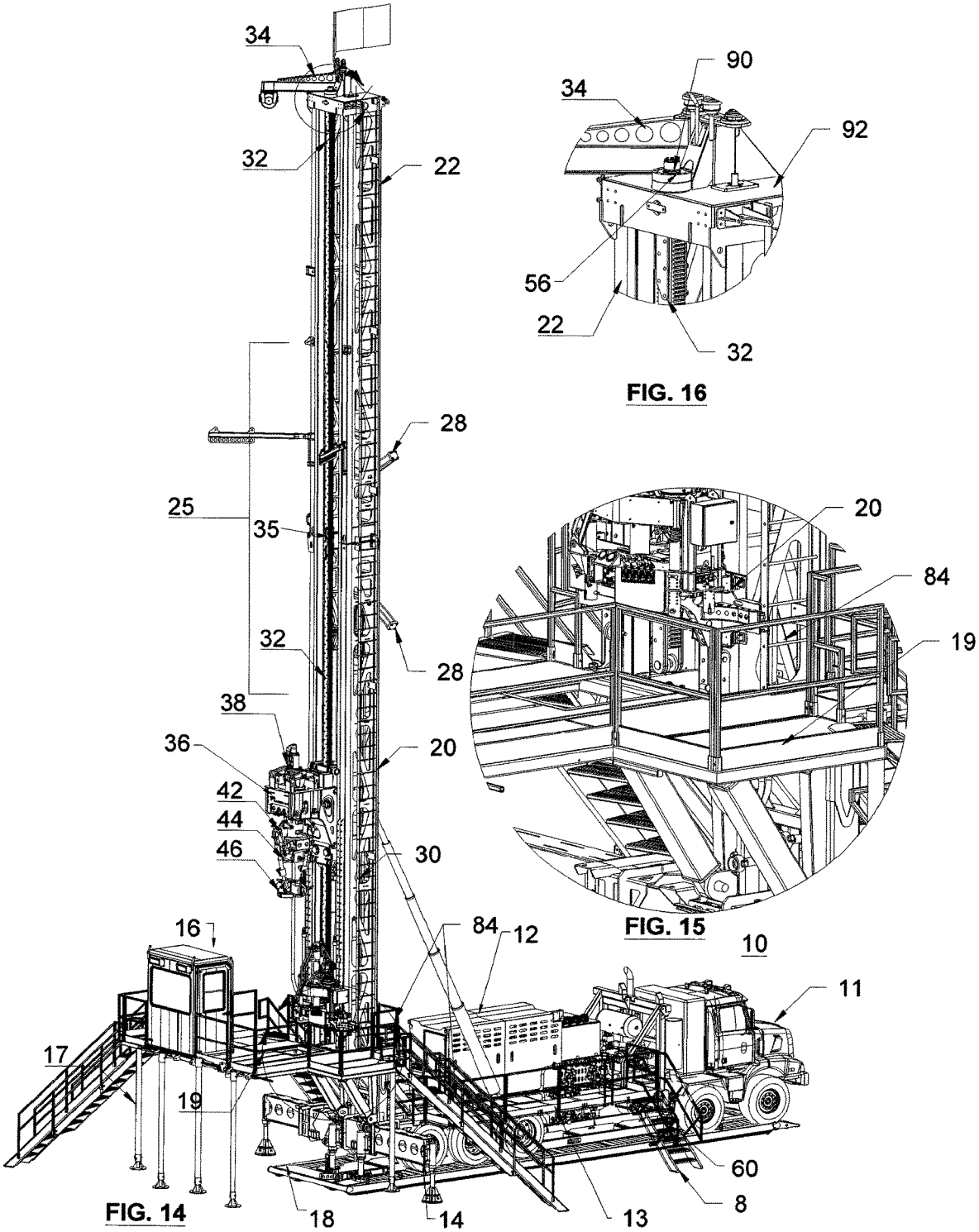
FIG. 14 is a right rear perspective view depicting the rig apparatus of FIG. 1.
FIG. 15 is a right rear perspective view depicting the lower end of the derrick mast of the rig apparatus as shown in detail J of FIG. 14.
FIG. 16 is a right rear perspective view depicting the upper end of the derrick mast of the rig apparatus as shown in detail I of FIG. 14.

In some embodiments, rig apparatus 10 can comprise walkways 13 and 15, as shown in FIGS. 1, 7 and 14, that can be pivotally attached thereto and rotate upwards from a vertical transport position to a horizontal working position to allow personnel to walk upon. Once rig apparatus 10 is positioned at well site, with walkways 13 and 15 and platform 19 moved to their respective working positions, stairways 8 and 9 can be placed adjacent to walkways 13 and 15, respectively, and stairway 17 can be placed adjacent to platform 19, all to provide personnel access from ground level. Stairways 21 and 23 can also be placed between walkways 13 and 15 and platform 19 to provide personnel access between the walkways and the platform. Handrails 84 can then be placed about walkways 13 and 15, platform 19 and stairways 8, 9, 17, 21 and 23 for the safety of personnel.

Figure 11:
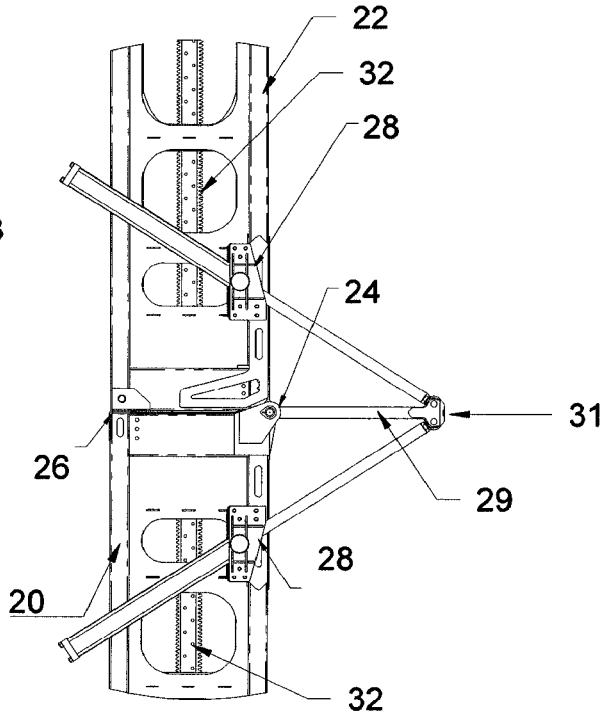
FIG. 11 is a front elevation view depicting the hinge joint of the derrick mast of the rig apparatus as shown in detail G of FIG. 10.
Figures 12, 13:
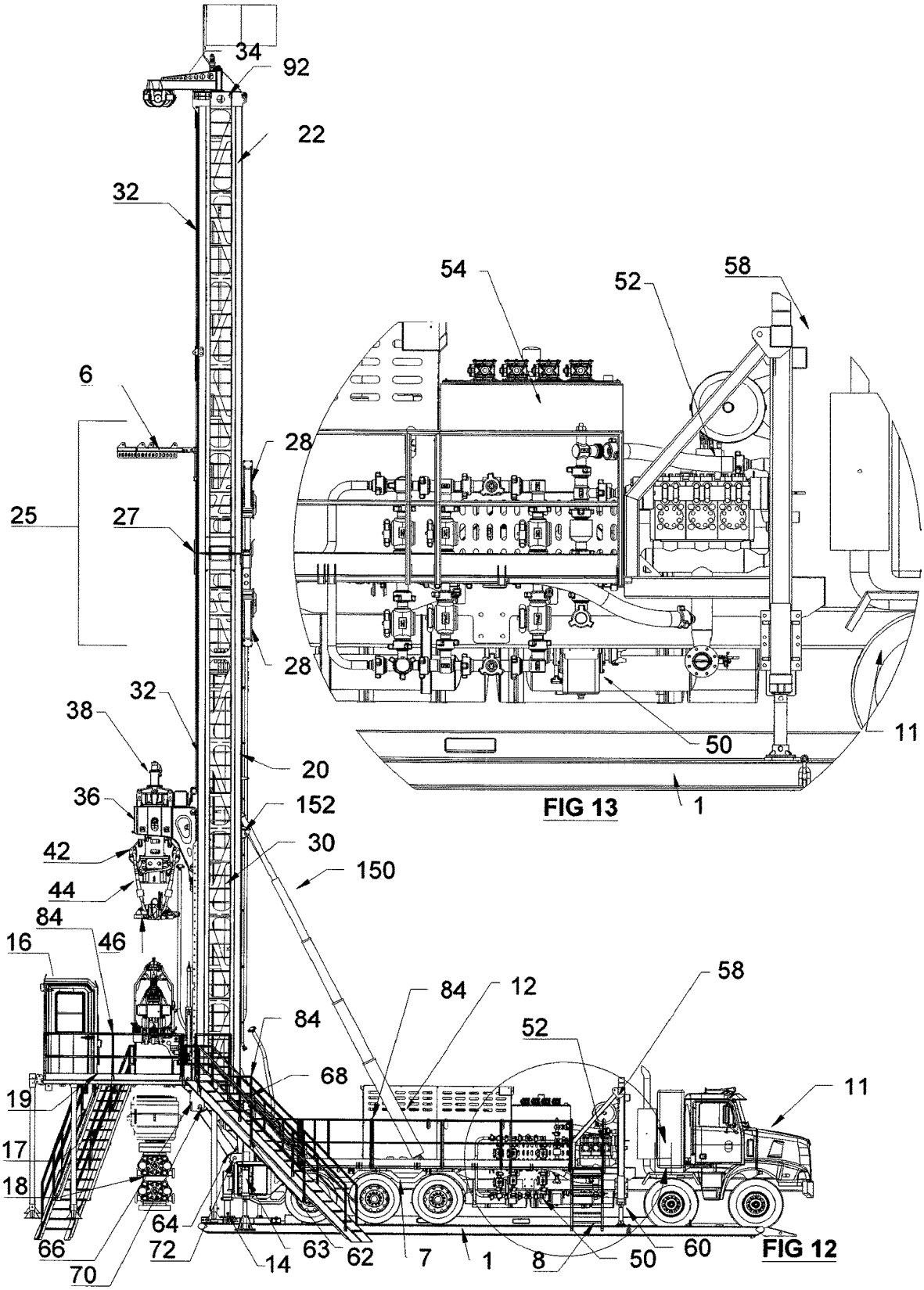
FIG. 12 is a right side elevation view depicting the rig apparatus of FIG. 1.
FIG. 13 is a right side elevation view depicting the hydraulic tank and the mud pump and manifold of the rig apparatus as shown in detail H of FIG. 12.

In some embodiments, rig apparatus 10 can comprise derrick mast 25, which can further comprise upper mast section 22 hinged to lower mast section 20 about hinge joint 24. Lower mast section 20 can further be pivotally attached to rig apparatus 10 via A-leg bracket 66 pivotally attached to A-leg 62 at pivot hinge 68 (see FIG. 12). Referring to FIG. 11, an example arrangement of derrick hinge 24 is shown in more detail. In some embodiments, derrick mast 25 can comprise pivot member 29 pivotally attached to hinge 24 at one end and can further comprise pivot bracket 31 disposed at its other end. Derrick jack knife hydraulic cylinders 28 pivotally attached to bracket 31 at one end, and pivotally attached to upper and lower mast sections 22 and 20, respectively, can provide the means for rotating upper mast section 22 relative to lower mast section 20. When cylinders 28 are retracted, upper mast section 22 can rotate about hinge 24 to fold upper mast section 22 to lower mast section 20, similar to closing a jack knife. When cylinders 28 are extended, upper mast section 22 can rotate about hinge 24 away from lower mast section 20, similar to opening a jack knife, and form derrick mast 25. Derrick pins 26 can then be placed to join upper and lower mast sections 22 and 20 together. This is generally done when upper and lower mast sections 22 and 20 are in a vertical position, such as shown in FIG. 1. In some embodiments, lower mast section 20 (with upper mast section 22 folded against lower mast section 20) can be raised to a vertical position first, and then upper mast section 22 can then be raised to form derrick mast 25. In some embodiments, derrick pins 26 can comprise hydraulically-operated pins to engage and lock upper mast and lower mast sections 22 and 20 together.

In some embodiments, derrick mast 25 can comprise hanging rack assembly 32 disposed therein. In some embodiments, rack assembly 32 can comprise a first part disposed in upper mast section 22 and a second part disposed in lower mast section 20. Rack assemblies 32 disposed in upper and lower mast sections 22 and 20 can be joined together at rack joint 35 with rack connector 27 to form a continuous rack assembly 32 within derrick mast 25.

In some embodiments, derrick mast 25 can pivot upwards on A-leg 62. Once in the substantially vertical working position, A-leg supports 64 can be coupled between A-leg bracket 66 at connection point 70 and lower bracket 63 at connection point 72.

In some embodiments, derrick mast 25 can further comprise tugger winches 34 disposed on top surface or crown 92 of upper mast section 22, which can be used as auxiliary winches for moving components or tools to or from platform 19, or about or around rig 10, generally. In some embodiments, tugger winches 34 can comprise hydraulic motors and can be controlled by a hydraulic power unit disposed on rig 10, can further be controlled by a programmable logic controller, which can further be operated by a radio-controller.

In some embodiments, sheave floor or sheave hanging arms 6 can be disposed from upper section 22 of the derrick, and can be used to hang wireline sheaves, or instrument cable sheaves.

Figure 25:
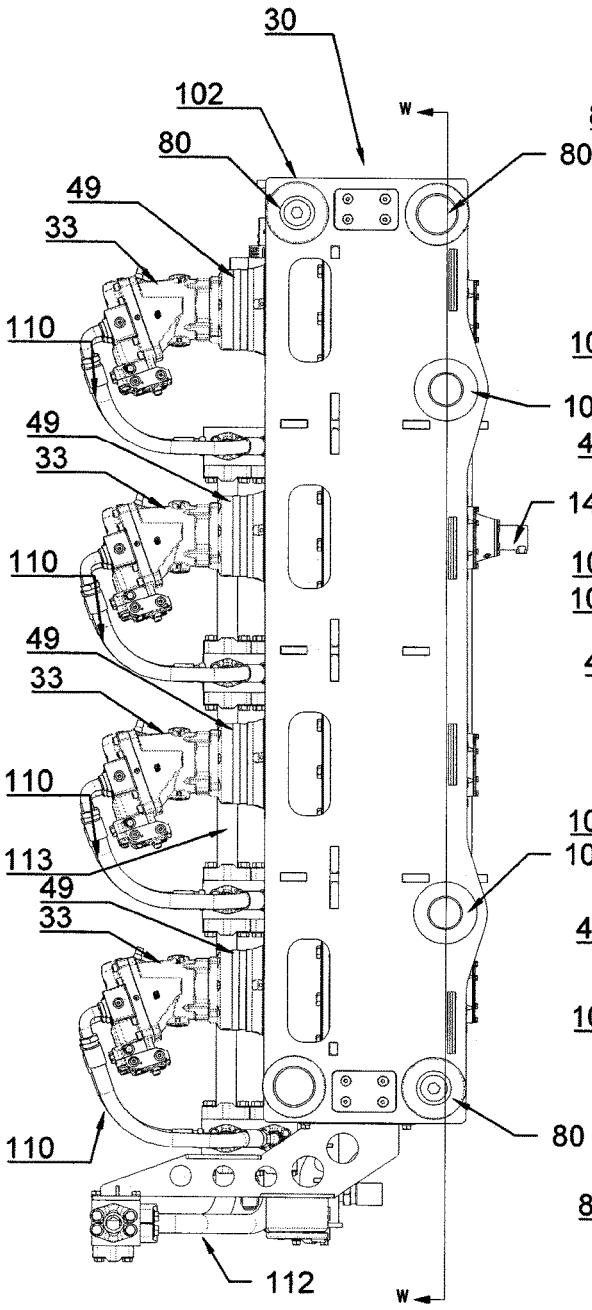
FIG. 25 is a side elevation view depicting the carriage drive assembly of the rig apparatus of FIG. 2.
Figure 26:
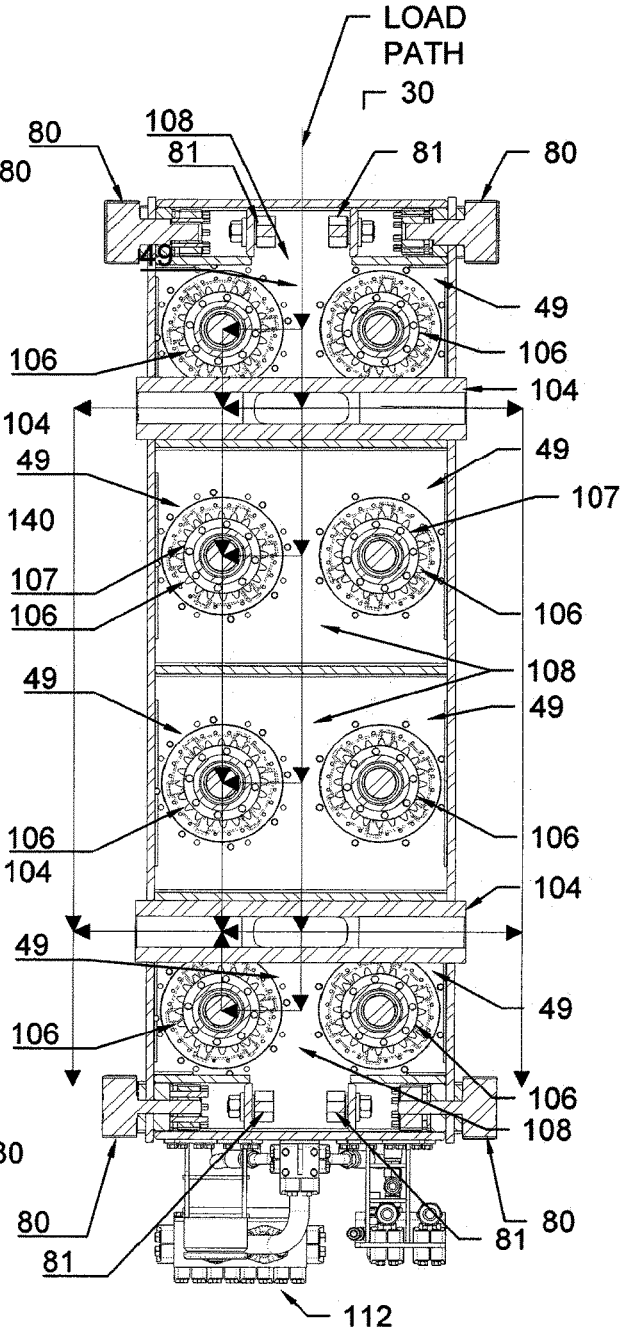
FIG. 26 is a front elevation cutaway view depicting the carriage drive assembly of FIG. 25 along section line W-W.
Figure 27:
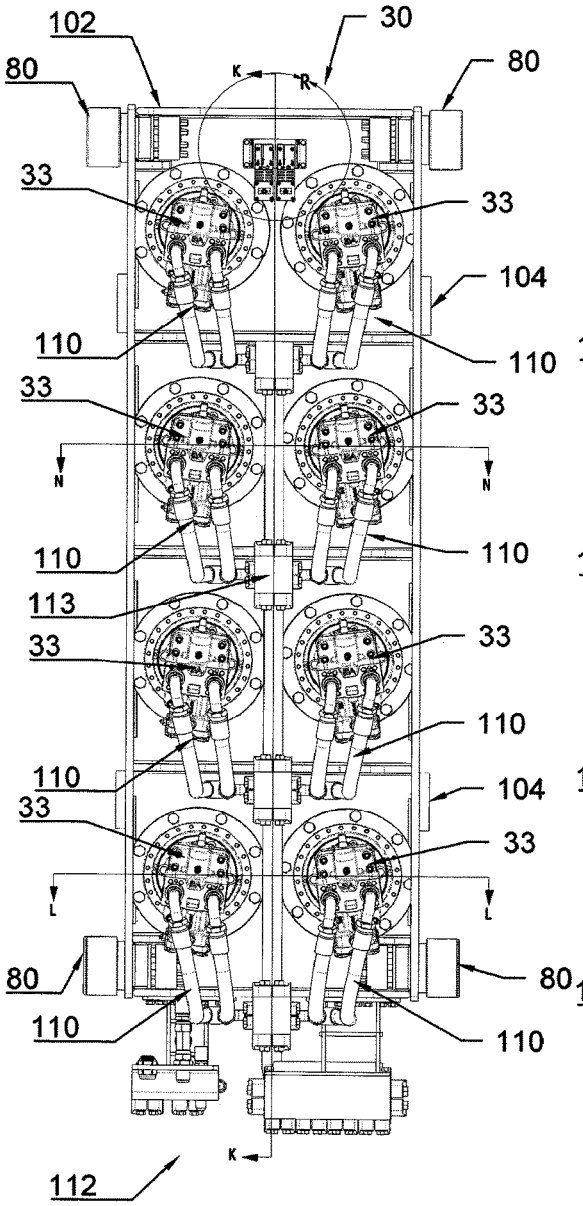
FIG. 27 is a rear elevation view depicting the carriage drive assembly of FIG. 25.
Figure 28:
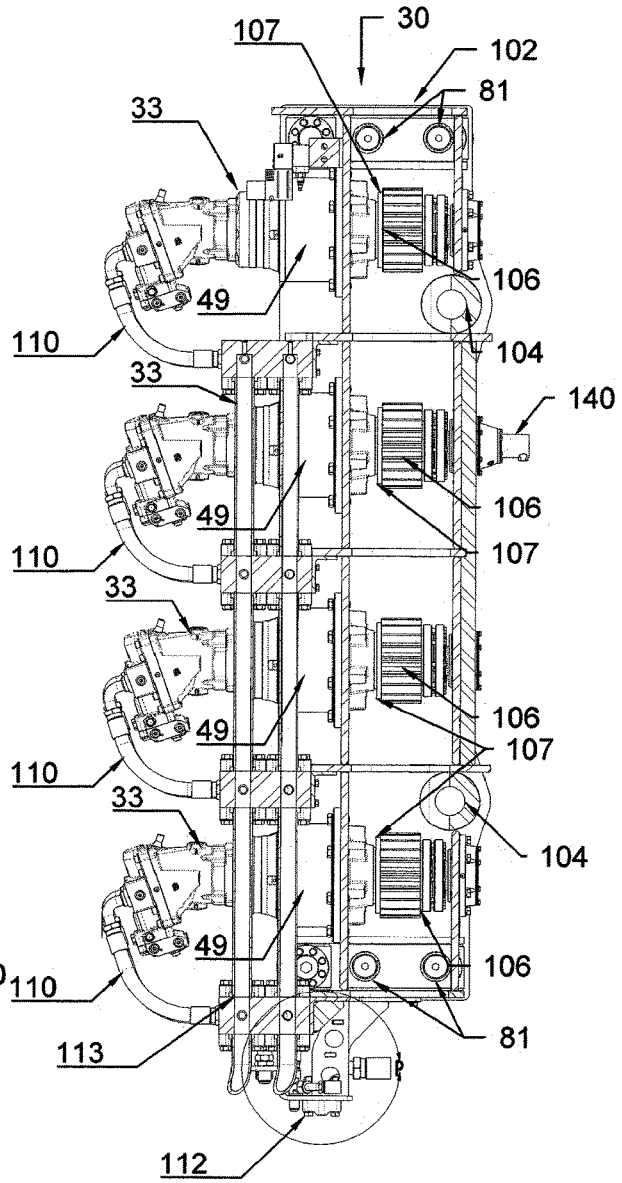
FIG. 28 is a side elevation cutaway view depicting the carriage drive assembly of FIG. 27 along section line K-K.
Figure 29:
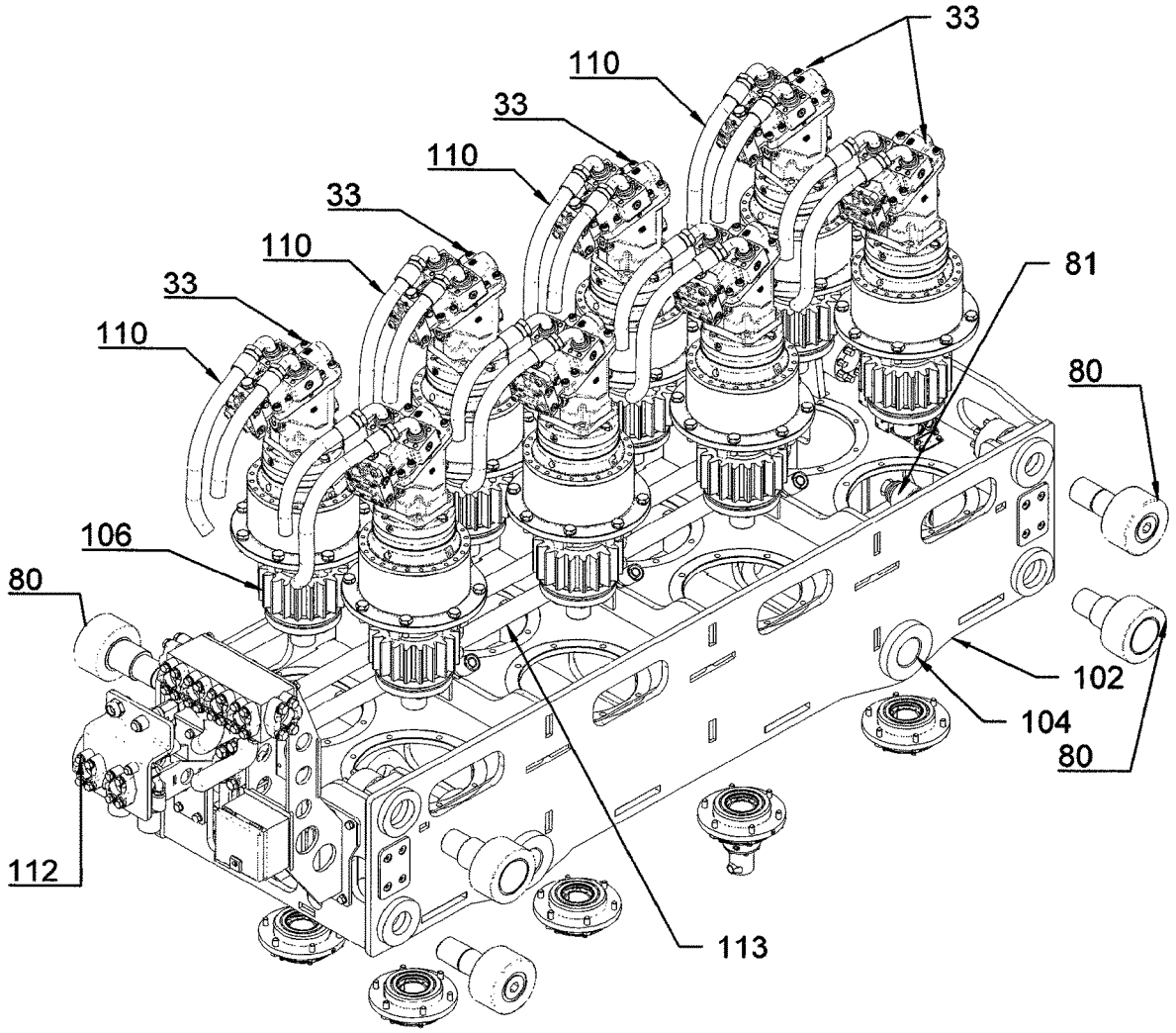
FIG. 29 is a rear perspective exploded view depicting the carriage drive assembly of FIG. 27.
Figure 30:
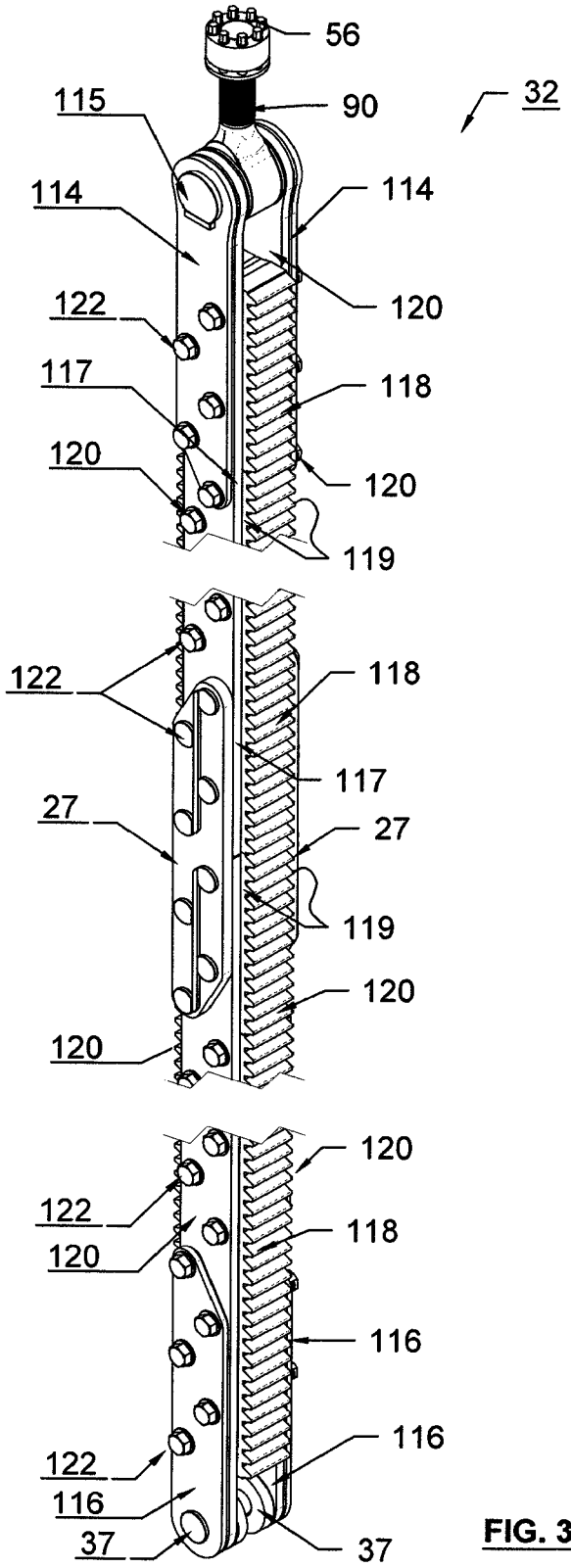
FIG. 30 is a perspective view depicting the rack assembly of the rig apparatus of FIG. 1.

In some embodiments, rig apparatus 10 can comprise carriage drive assembly 30 slidably disposed in derrick mast 25, as shown in FIGS. 1, 2, 4, 5, 10, 12, 14 and 25 to 29. Carriage drive assembly 30 can comprise carriage frame 102, further comprising a plurality of trolley wheels 80 configured to straddle and/or roll along derrick tracks or guides 82 disposed on derrick mast 25. In some embodiments, carriage frame 102 can further comprise rack guide rollers 81 (as shown in FIGS. 26, 28 and 29) to guide rack 32 through carriage drive assembly 30 and insure proper gear tooth geometry. In some embodiments, rollers 81 can roll on side surfaces 119 of rack sections 118 (as shown in FIG. 30) to keep rack 32 centered within carriage drive assembly 30 and properly engaged with pinion gears 106 (as shown in FIGS. 26, 28 and 29). Carriage frame 102 can further comprise pin receivers 104 disposed therein configured for receiving pins 40 when attaching tool carrier 36 to carriage drive assembly 30. A plurality of pinion motors 33 disposed on carriage frame 102, wherein each motor 33 can comprise a pinion gear 106, and gear backlash wheel 107, that can further engage rack assembly 32 in a rack and pinion configuration when rack 32 disposed along rack opening 108 to enable carriage drive assembly 30 to move upwards or downwards along derrick mast 25 upon operation of pinion motors 33. In some embodiments, backlash wheels 107 can comprise a ring disposed on the end face of pinion gears 106. In some embodiments, backlash wheels 107 can roll on edge surface 117 of plates 120 (as shown in FIG. 30) to keep rack 32 centered within carriage drive assembly 30 and properly engaged with pinion gears 106 by maintaining a correct depth of tooth engagement between pinion gears 106 and the teeth disposed on rack sections 118 of rack 32. In some embodiments, carriage drive assembly 30 can further comprise encoder 140 (as shown in FIGS. 25 and 28) for detecting and monitoring the position of carriage drive assembly 30 within the derrick. With this configuration, carriage assembly 30 can be used not only to pull pipe up out of a wellbore, but can also be used to push pipe into a wellbore, as can be required when drilling or servicing horizontal wells.

In some embodiments, pinion motors 33 can comprise a variable displacement hydraulic motor. In a representative embodiment, a Series 51, 80 cc bent-axis hydraulic motor as manufactured by Sauer-Danfoss Gmbh & Co. OHG of Neumunster, Germany can be used as motor 33, although functionally equivalent motors can be used, as well known to those skilled in the art. In some embodiments, each pinion motor 33 can be coupled to hydraulic distribution manifold 113 via hydraulic lines 110. Manifold 113 can, in turn, be coupled to hydraulic manifold system 112, which is configured to be coupled to the hydraulic power unit disposed on rig apparatus 10.

In some embodiments, each pinion motor 33 can further comprise gear reducer 49, that incorporate disc brake assemblies disposed between motor 33 and pinion gear 106. In representative embodiments, gear reducer 49 can comprise a planetary gear reducer, and disc brake assembly, as manufactured by Auburn Gear Inc. of Auburn, Ind., U.S.A.

Figure 31:
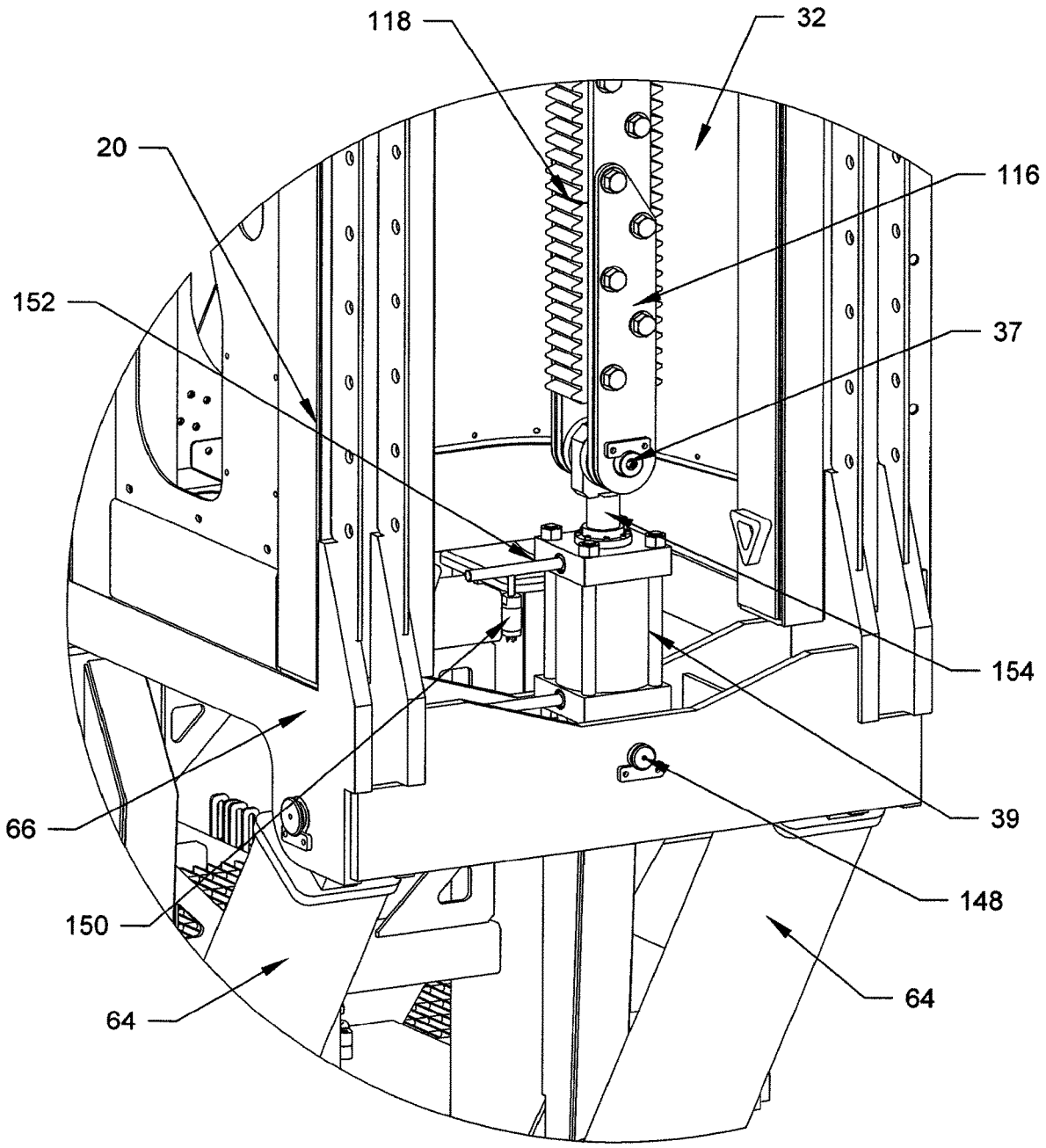
FIG. 31 is a perspective view depicting the connection of the lower end of the rack assembly to the lower end of the derrick mast.

Referring to FIG. 30, a representative embodiment of rack assembly 32 is shown. In some embodiments, rack assembly 32 can comprise a plurality of toothed rack sections 118 sandwiched between plates 120, which can be fastened together with bolts 122, aligned with dowel pins. At an upper end of rack assembly 32, assembly 32 can further comprise reinforcing plates 114 sandwiching rack section 118, plates 120 and fastener 90, all secured by bolts 122. Fastener 90 can be further coupled to load cell 56, as further described below and shown in FIG. 16. At a lower end of rack assembly 32, assembly 32 can further comprise reinforcing plates 116 (see FIGS. 30 and 31) sandwiching the rack section 118 and plates 120, all secured by bolts 122. Plates 116 can further comprise lower rack cylinder connections for attachment to rod end 154 of rack cylinder 39, as shown in FIG. 31, secured via load pin 37. The lower end of rack cylinder 39 can be coupled to the lower end of the derrick mast frame via pin 148.

Figure 32:
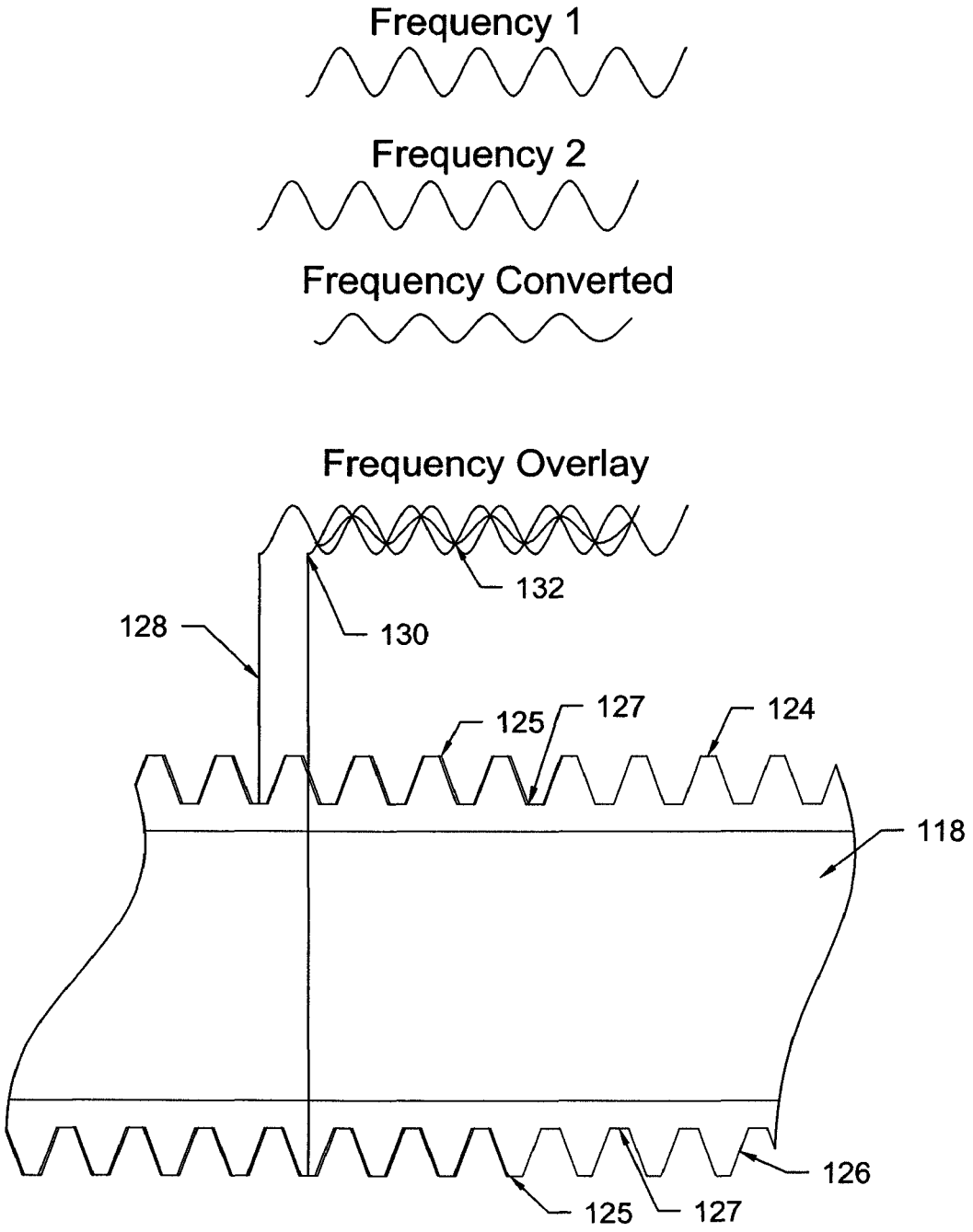
FIG. 32 is a front elevation view depicting a section of the rack assembly of FIG. 30.
Figure 33A:
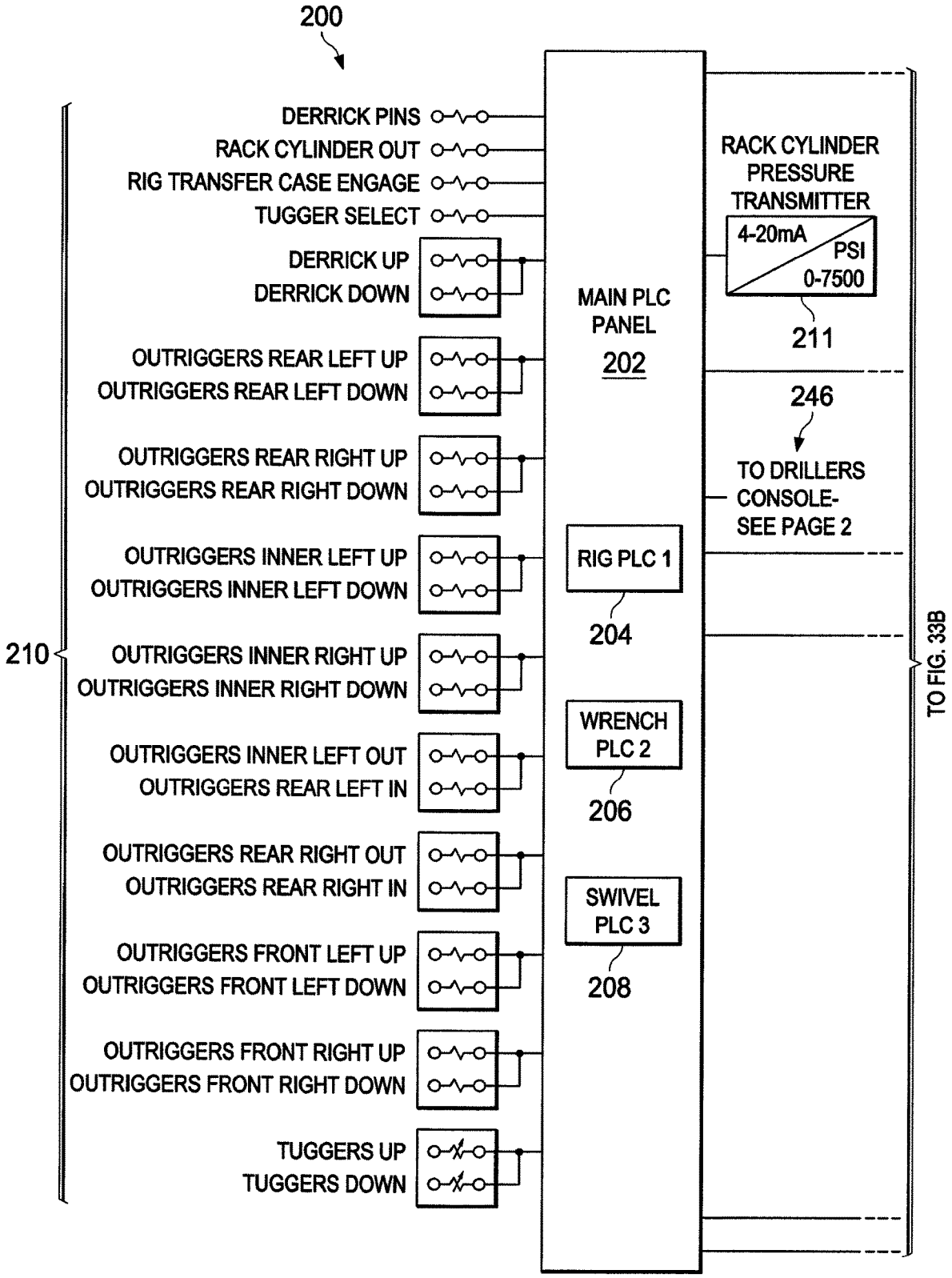
FIGS. 33A-33D (collectively FIG. 33) is a block diagram depicting the control system of the rig apparatus of FIG. 1.
Figure 33B:
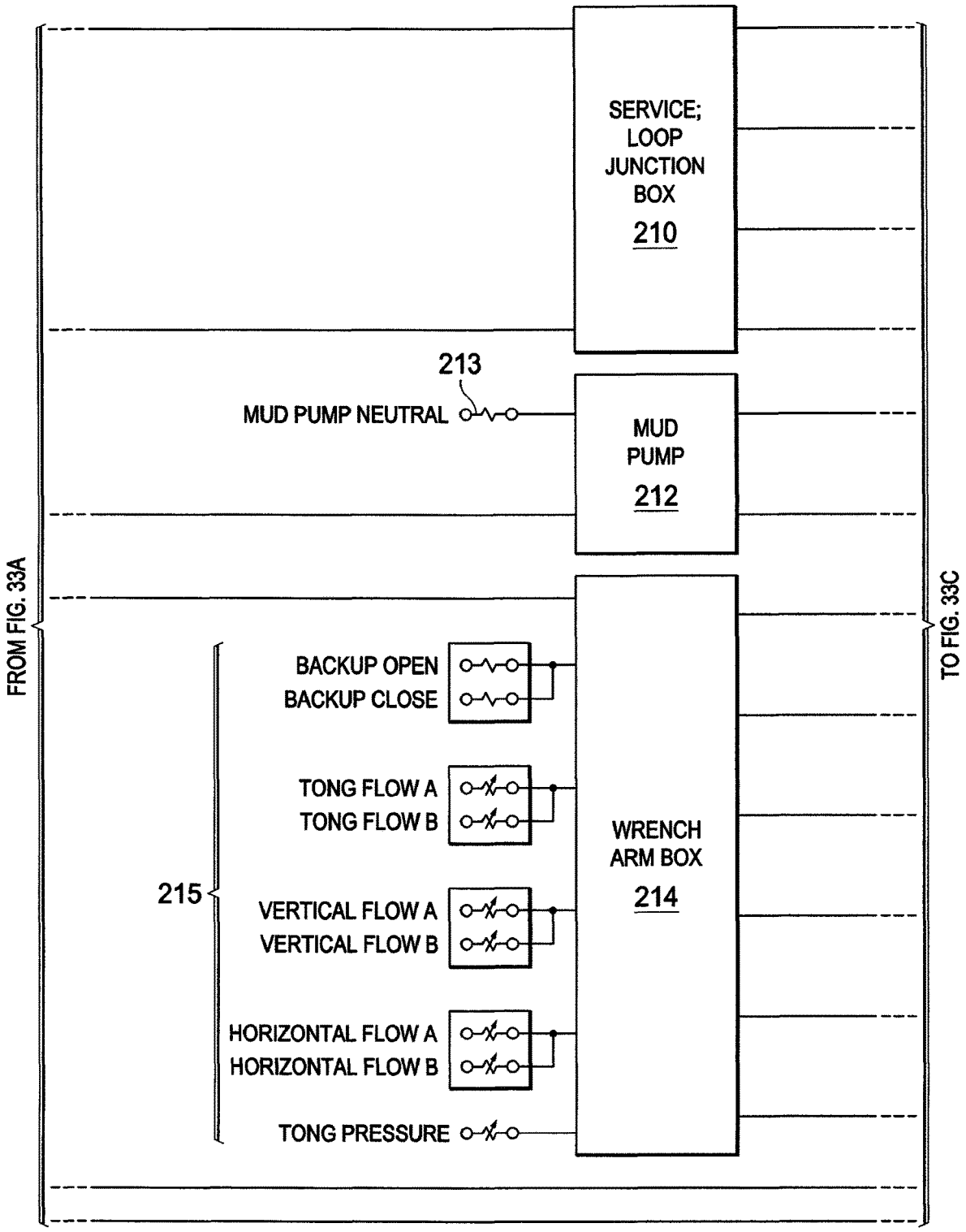
Figure 33C:
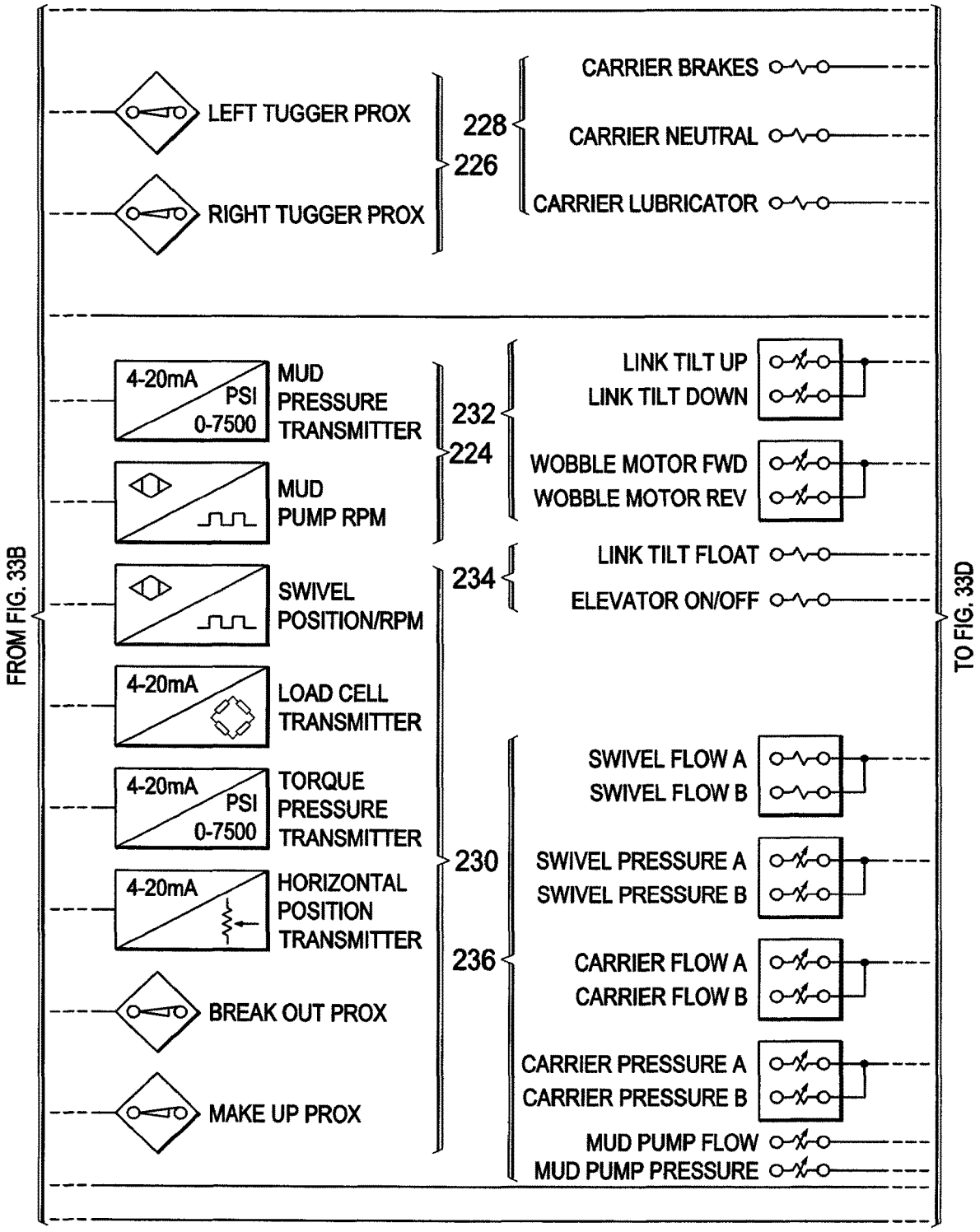
Figure 33D:
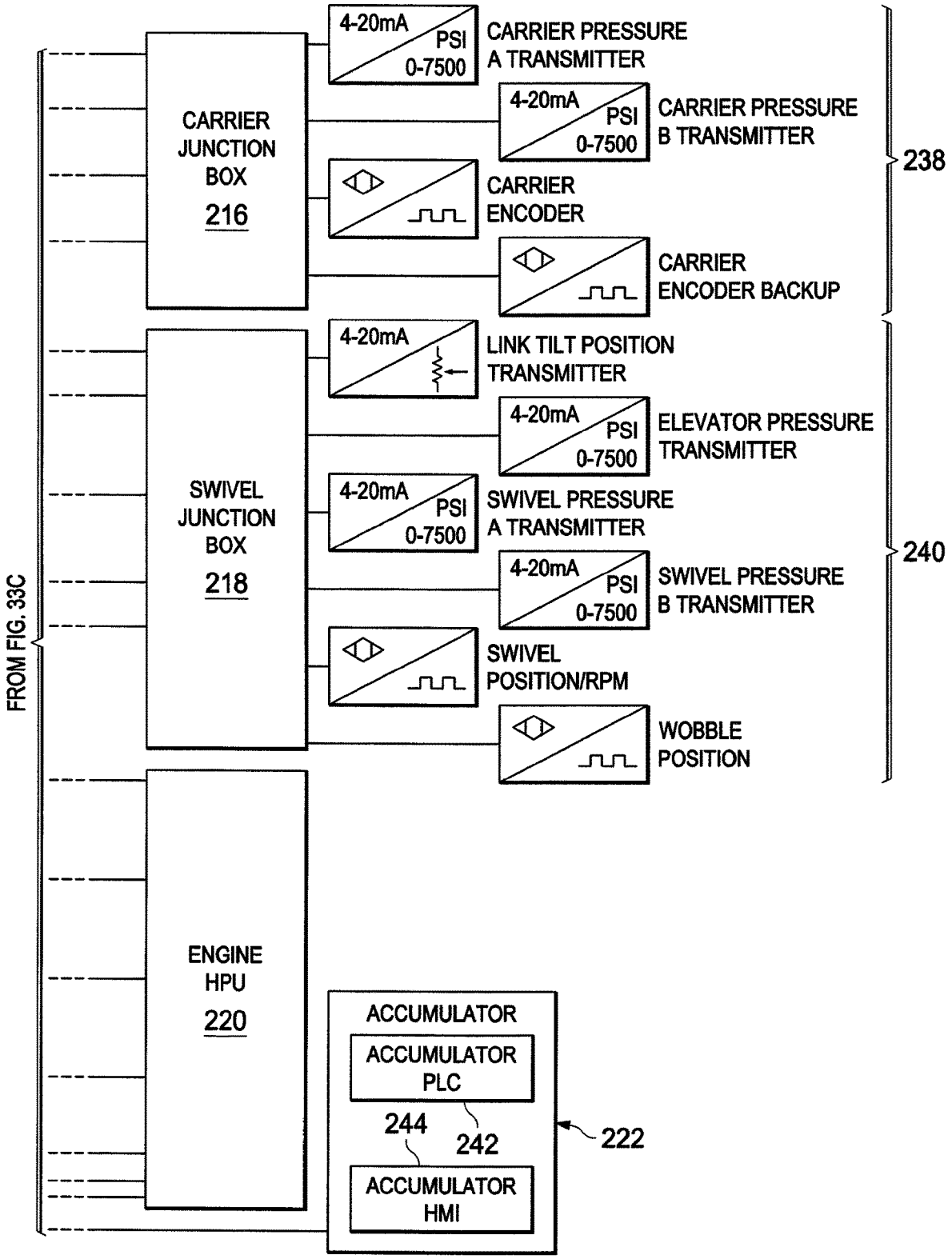

Referring to FIG. 32, a portion of a rack section 118 is shown. In some embodiments, rack sections 118 can comprise teeth 124 and 126 disposed on opposed sides of the rack section for engaging with pinion gears 106 disposed on motors 33. In some embodiments, teeth 124 can be offset from teeth 126 wherein the peaks 125 and valleys 127 of teeth 124 and 126 do not line up. In this configuration, the vibration 128 that can be generated when pinion gears 106 engage teeth 124 can be shifted in phase from the vibration 130 that can be generated when pinion gears 106 engage teeth 126 such that the combination of vibrations 128 and 130 can produce combined vibration 132, which can be lower in amplitude than either of vibrations 128 and 130, individually. In other words, by offsetting the position of teeth 124 relative to teeth 126, the overall vibration generated when pinion gears 106 engage teeth 124 and 126 can be reduced.

In some embodiments, carriage drive assembly 30 can be configured to receive tool carrier 36 or other tools well known to those skilled in the art, releasably attached to carriage drive assembly 30 with pins 40. In some embodiments, tool carrier 36 can be configured to hold any tool used in the drilling or servicing of wells, as well known to those skilled in the art. As shown in FIGS. 2 and 21-30, tool carrier 36 can comprise a top drive or power swivel, labelled as reference numeral 38. In the drilling of wells, a top drive unit can be used. In the servicing of wells, a power swivel or a top drive can be used. As well known to those skilled in the art, top drives and power swivels can be similar in function and operation, the difference being that top drives can be larger in size and power, as required for the drilling of wells.

Figure 23:
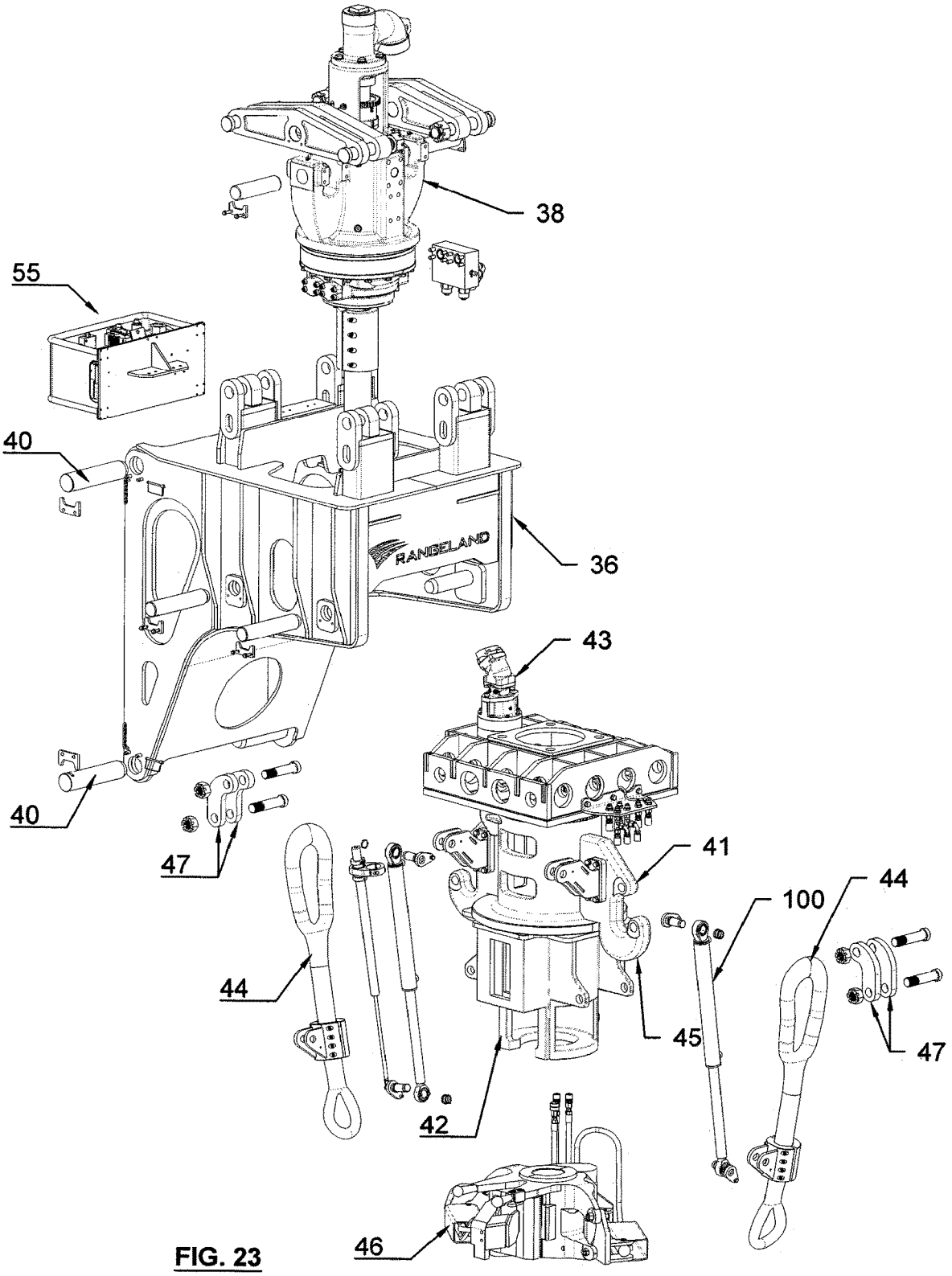
FIG. 23 is a perspective exploded view depicting the tool carrier of FIG. 21.
Figure 24:
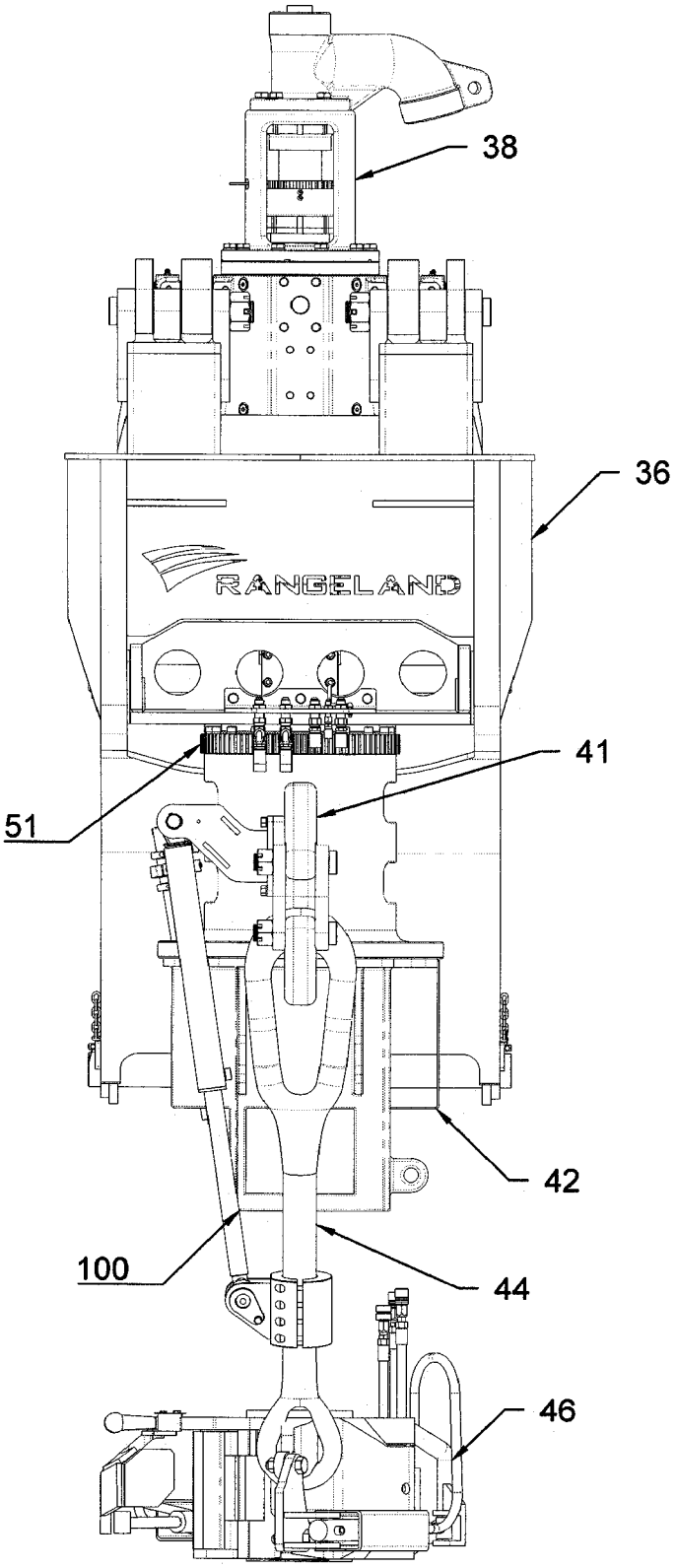
FIG. 24 is a front elevation view depicting the tool carrier of FIG. 21 with the elevators shown in a raised and lowered position.

In some embodiments, tool carrier 36 can comprise one or more other tools such as push slips 42, wobble drive motor 43 that can rotate slew bearing gear set 51 about the longitudinal axis of the pipe so as to enable pivot box assembly 41 to wobble pipe side to side while rotating the pipe to reduce friction as the pipe is pushed into a wellbore, a rotating pipe handle, a coil tubing injector, a continuous rod injector and a sand line drawworks, all well known to those skilled in the art. In some embodiments, motor 43 can comprise a Series 51, 80 cc bent-axis hydraulic motor as manufactured by Sauer-Danfoss Gmbh & Co. OHG of Neumunster, Germany. In some embodiments, tool carrier 36 can comprise links 44 connected to elevators 46 that can be used to grab and lift pipe as it is being tripped into or out of a well bore. In some embodiments, links 44 can be supported by hooks 45 and kept in place with retainers 47 secured to hooks 45, such as with nuts and bolts as one example. In some embodiments, tool carrier 36 can comprise hydraulic cylinders 100 operatively disposed between links 44 and pivot box assembly 41. Cylinders 100 can enable the lifting and pivoting of elevators 46 with respect to pivot box assembly 41, as shown in FIG. 24. When cylinders 100 are retracted, elevators 46 can be pivoted upwards to receive a section of pipe when tripping the drill string into a well, or present a section of pipe to a pipe handling apparatus when tripping the drill string out of the well. When cylinders 100 are extended, elevators 46 can be pivoted downwards until links 44 are substantially vertical in position. In some embodiments, elevators 46 can be pivoted up to 73 degrees upwards from vertical. Referring to FIG. 23, tool carrier 36 can further comprise hydraulic valve box 55, which can comprise the hydraulic control valves required for controlling the hydraulic systems disposed on tool carrier 36.

In some embodiments, rig apparatus 10 can comprise mud pump system 48 disposed on frame 7, which can further comprise mud pump motor 53, mud pump 52 and mud pump manifold 50. Mud pump motor 53 can be a hydraulic motor operatively connected to mud pump 52, which can be configured to pump drilling mud from a supply of drilling mud (not shown) through manifold 50. In some embodiments, manifold 50 can comprise hydraulic actuators to remotely actuate individual valves to change or divert the flow path to and from the well.

In some embodiments, hydraulic drive assembly 12 can comprise hydraulic drive components, as well known to those skilled in the art. In some embodiments, hydraulic drive assembly 12 can comprise an internal combustion engine, such as a diesel engine, or electric motor, to operate a hydraulic pump to pump hydraulic fluid, stored in hydraulic fluid tank 54, under pressure to operate the various hydraulic functions, valves, cylinders and hydraulic motors disposed on rig apparatus 10. These can include cylinders 28, main cylinder 150 (disposed between frame 7 and derrick mast 25 and configured to raise mast 25 to a substantially vertical position), pinion motors 33, mud pump motor 53, tugger winches 34 among other hydraulically-powered devices as required on drilling or servicing rigs, and as well-known to those skilled in the art. In some embodiments, hydraulic drive assembly 12 can further comprise fluid filters, fluid cooling radiators, hydraulic control valves and other hydraulic fluid components, as well known to those skilled in the art, for controlling the flow of hydraulic fluid to the various hydraulic cylinders and hydraulic motors disposed on rig apparatus 10.

In some embodiments, rig apparatus 10 can comprise means for measuring the pull force when pulling pipe out of a wellbore, and can further comprise means for measuring the push force when pushing pipe into a wellbore. Referring to FIG. 16, the upper end of rack assembly 32 can be attached to top surface or crown 92 of upper mast section 22 with fastener 90 with upper rack load cell 56 disposed therebetween. When carriage assembly 30 is being used to pull pipe up, the pulling force causes rack assembly 32 to be pulled downwards thereby compressing upper rack load cell 56 against top surface or crown 92. Upper rack load cell 56 can be any suitable load cell operatively connected to load cell monitoring equipment, as well known to those skilled in the art, to measure the pull force exerted on the pipe being pulled up by carriage drive assembly 30 and tool carrier 36.

Figure 18:
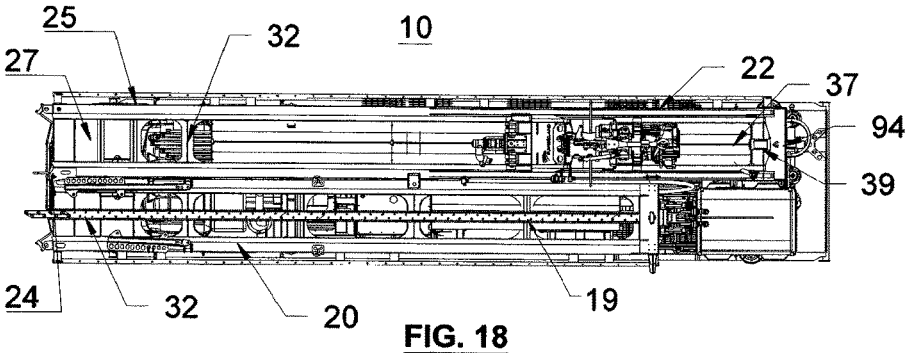
FIG. 18 is a top plan view depicting the rig apparatus of FIG. 17.
Figure 19:
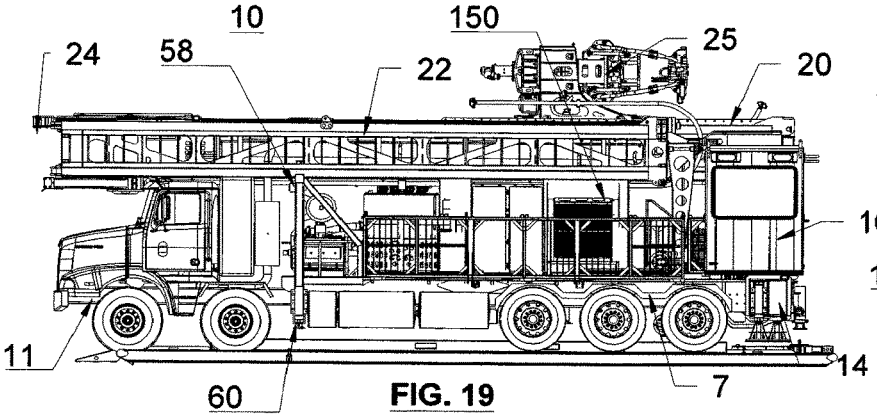
FIG. 19 is a left side elevation view depicting the rig apparatus of FIG. 17.
Figure 20:
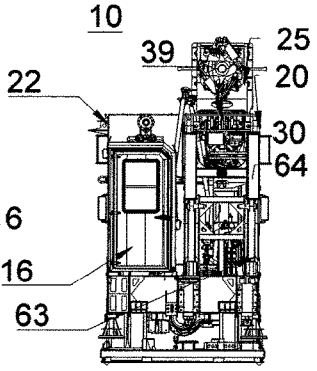
FIG. 20 is a rear elevation view depicting the rig apparatus of FIG. 17.
Figure 21:
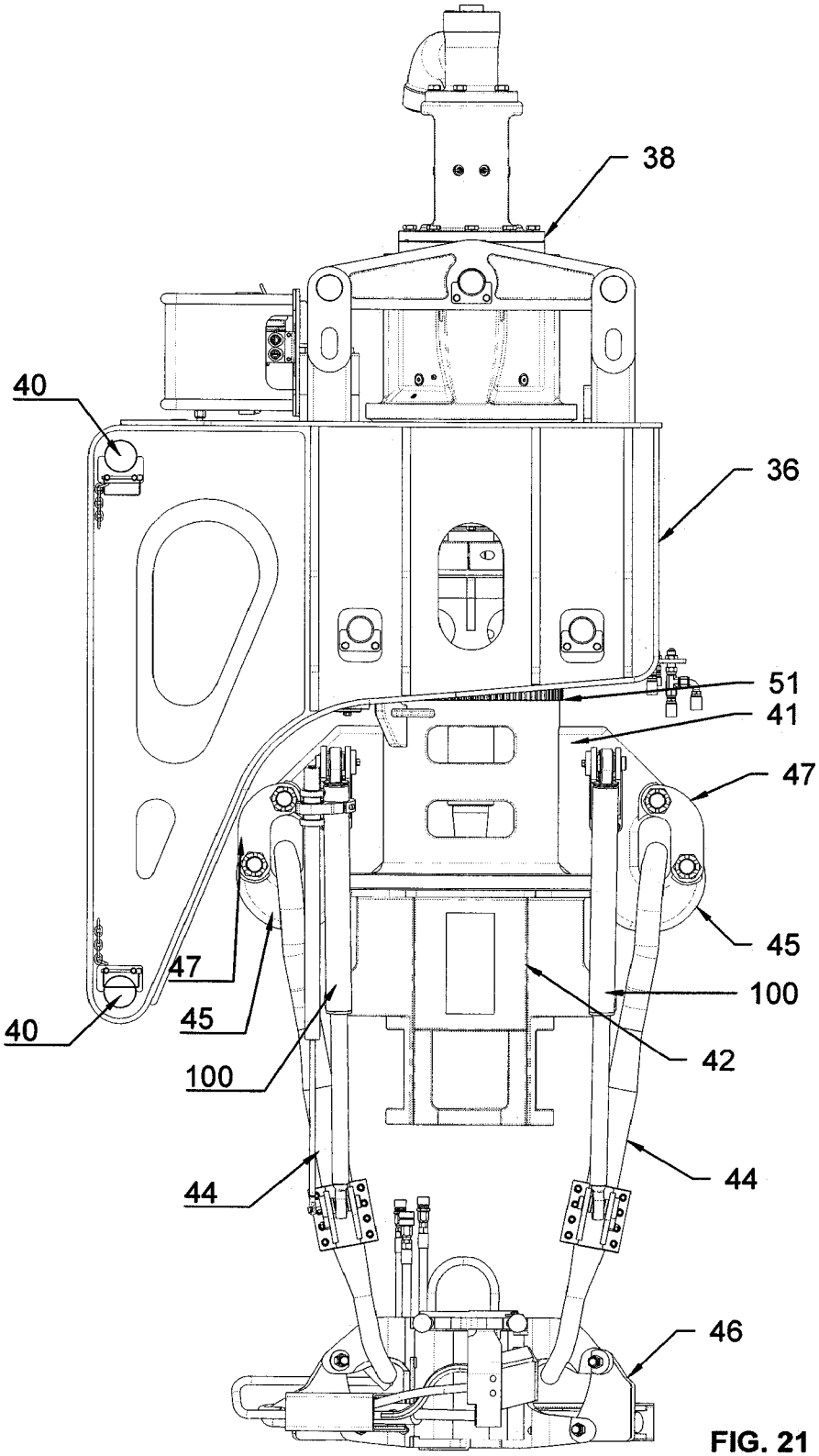
FIG. 21 is a side elevation view depicting the tool carrier of the rig apparatus of FIG. 5.
Figure 22:
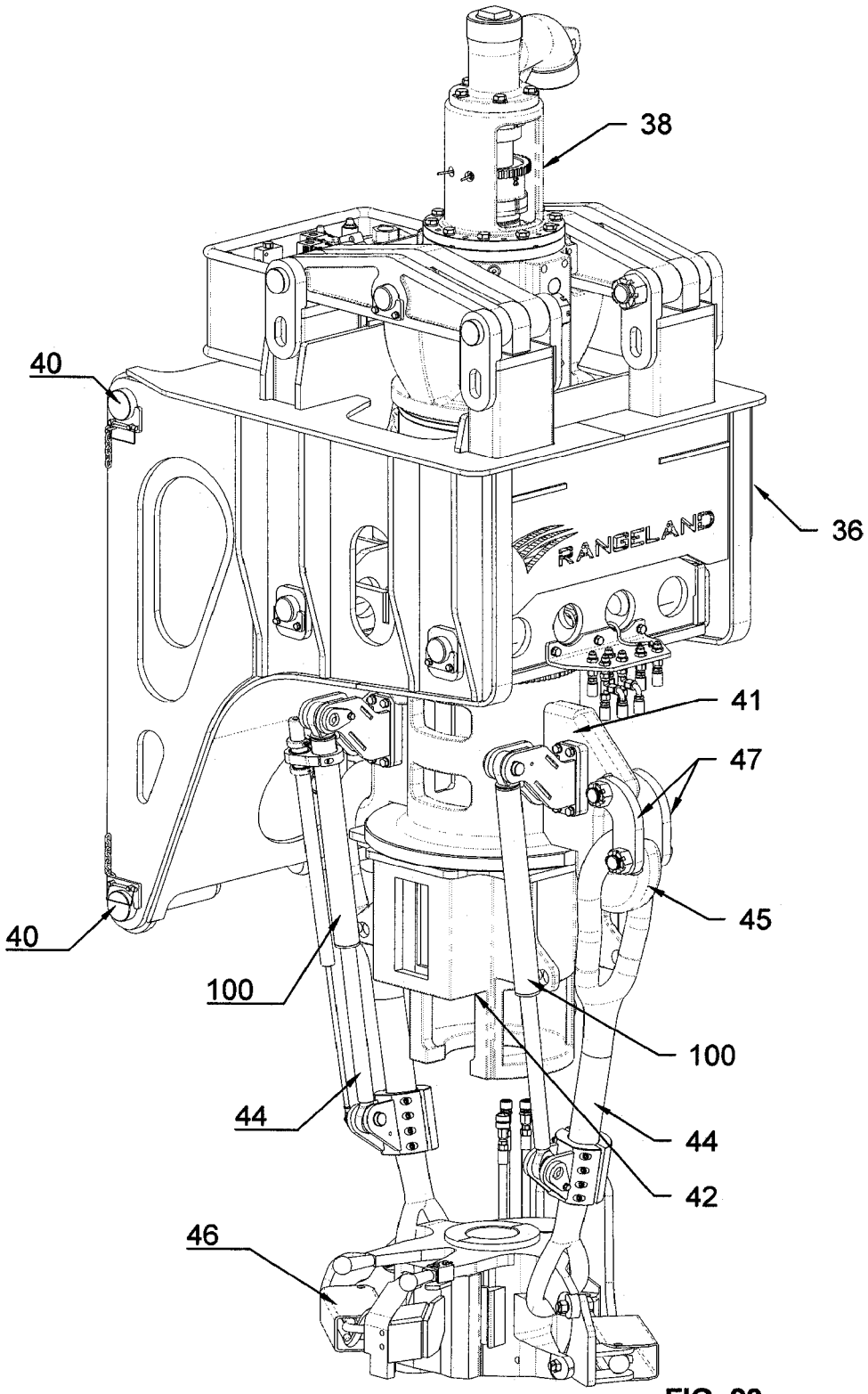
FIG. 22 is a perspective view depicting the tool carrier of FIG. 21.
Figure 34:
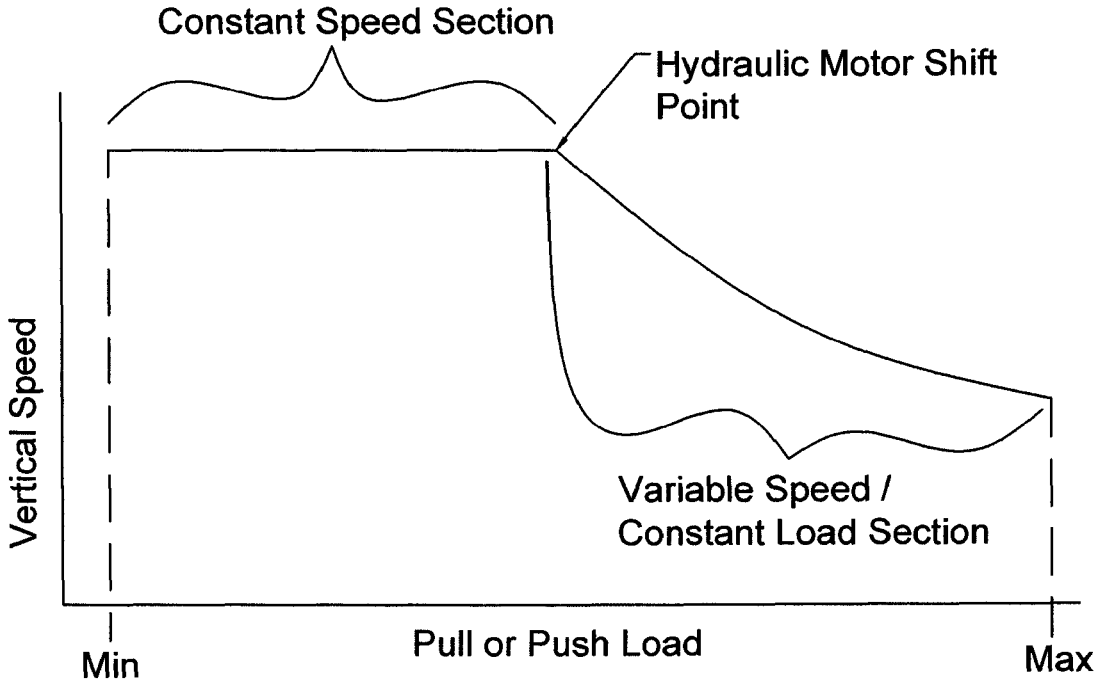
FIG. 34 is an X-Y graph depicting the vertical speed of the carriage drive assembly of the rig apparatus of FIG. 1 as a function of the pull or push load on the carriage drive assembly.

Referring to FIGS. 15, 17 and 18, the lower end of rack assembly 32 can be attached to lower rack hydraulic cylinder 39 at lower rack connection 37, in turn, can be attached to lower bracket 94, disposed on the lower end of lower mast section 20. When upper and lower mast sections 22 and 20 are assembled into derrick mast 25, and the rack assemblies 32 therein connected at rack joint 35, lower rack cylinder 39 can be retracted to place rack assembly 32 under tension within derrick mast 25. When carriage assembly 30 is being used to push pipe down, the pushing force causes rack assembly 32 to be pulled upwards thereby exerting a pull force on lower rack cylinder 39. In some embodiments, pressure transducer 150 (as shown in FIG. 31) can be operatively coupled to lower rack cylinder 39, via hydraulic lines 152, and can be further used to measure the hydraulic fluid pressure within rack cylinder 39, which can represent the load applied to the load pin 37, that is, the push force exerted on the pipe by carriage drive assembly 30 and tool carrier 36 when pushing drill pipe into wellbore, as can be required during the drilling of horizontal wells. Referring to FIG. 34, an X-Y graph is shown representing the vertical speed at which carriage drive assembly 30 can travel up or down rack assembly 32 as a function of the pull or push load being exerted by carriage drive assembly 30. At lighter loads, carriage drive assembly 30 can travel at a constant speed along rack assembly 32 until the load increases to a particular threshold that represents the shift point of motors 33, at which point the vertical speed decreases as the load increases to the maximum load that can be handled by the specific hydraulic drive system. This system can be sized to accommodate different classifications of rigs.

In some embodiments, rack assembly 32 can hang from crown 92. In these embodiments, rack assembly 32 can self-align as it passes through carriage drive assembly 30. This can also allow carriage drive assembly 30 to follow derrick guides 82, and to allow rack assembly 32 to flex or move within derrick mast 25 to locate itself where carriage drive assembly 30 needs it.

In some embodiments, rig apparatus 10 can comprise a programmable logic controller ("PLC") configured to control a bank of hydraulic control valves, or other devices that can control the flow of pressurized hydraulic fluid to the various hydraulically-powered devices disposed on rig apparatus 10, such as hydraulic cylinders and hydraulic motors, and for power supplying hydraulic power to other components or tools, such as a power tong disposed on platform 19, as well known to those skilled in the art.

Referring to FIG. 33, a block diagram of an embodiment of PLC control system 200 for use with rig apparatus 10 is shown. In some embodiments, control system 200 can comprise main PLC panel 202, which can further comprise rig PLC 204, wrench PLC 206 and swivel PLC 208. Rig PLC 204 can be configured to operate the structural features of rig apparatus 10, such as outriggers 14 and 60, main cylinder 150 for raising derrick 25, rack cylinders 39 for extending mast 25 and tugger winches 34. Wrench PLC 206 can be configured to operate a tong wrench disposed on platform 19 (not shown). Swivel PLC 208 can be configured to operate top drive or power swivel 38. Operatively coupled to main PLC panel 202 can be controls, identified by reference numeral 210, configured to operate these structural features. Rack cylinder pressure transducer 211, which can be operatively coupled to rack hydraulic cylinder 39, as described above, can be operatively coupled to rig PLC 204 via panel 202.

In some embodiments, control system 200 can comprise service loop junction box 210 operatively coupled to main PLC panel 202. Tugger winch proximity sensors 226 can be coupled to rig PLC 204 via junction box 210 and main PLC panel 202.

In some embodiments, control system 200 can comprise carrier junction box 216 operatively coupled to main PLC panel 202 via junction box 210. Carrier controls 226 can be coupled to rig PLC 204 via junction boxes 216 and 210 and main PLC panel 202. Various carrier sensors 238, such as carrier pressure A transmitter, carrier pressure B transmitter, carrier encoder and carrier encoder backup, can be coupled to rig PLC 204 via junction boxes 216 and 210 and main PLC panel 202.

In some embodiments, control system 200 can comprise swivel junction box 218 operatively coupled to main PLC panel 202 via junction box 210. Controls 232 and 234 can be coupled to swivel PLC 208 via junction boxes 218 and 210 and main PLC panel 202. Controls 232 can be used to tilt links 44 up or down, and operate the wobble motor. Controls 234 can be used to operate the link 44 tilt float and elevator 46 on and off. Various swivel sensors 240, such as link tilt position transmitter, elevator pressure transmitter, swivel pressure A transmitter, swivel pressure B transmitter, swivel position/RPM sensor and wobble position sensor, can be coupled to swivel PLC 208 via junction boxes 218 and 210 and main PLC panel 202.

In some embodiments, control system 200 can comprise mud pump junction box 212 operatively coupled to main PLC panel 202. In some embodiments, mud pump neutral control 213 can be operatively coupled to swivel PLC 208 via junction box 212 and main PLC panel 202. Mud pump sensors 224, such as mud pressure transmitter and mud pump RPM sensor, can be operatively coupled to swivel PLC 208 via junction box 212 and main PLC panel 202.

In some embodiments, control system 200 can comprise wrench arm junction box 214 operatively coupled to main PLC panel 202. In some embodiments, wrench controls 215 can be operatively coupled to wrench PLC 206 via junction box 214 and main PLC panel 202. In some embodiments, wrench arm sensors 230 can be operatively coupled to wrench PLC 206 via junction box 214 and main PLC panel 202.

In some embodiments, control system 200 can comprise engine hydraulic power unit ("HPU") 220 operatively coupled to one or more of PLCs 204, 206 and 208 via main PLC panel 202. Hydraulic fluid sensors 236, such as swivel flow A and B sensors, swivel pressure A and B sensors, carrier flow A and B sensors, carrier pressure A and B sensors, mud pump flow sensor and mud pump pressure sensor, can be coupled to engine HPU 220 and/or to one or more of PLCs 204, 206 and 208 via engine HPU 220 and main PLC panel 202.

In some embodiments, control system 200 can comprise accumulator PLC 242 and accumulator human machine interface ("HMI") 244 operatively coupled to one or more of PLCs 204, 206 and 208 via accumulator junction box 222 and main PLC panel 202. In some embodiments, control system 200 can comprise operator's console 246 operatively coupled to one or more of PLCs 204, 206 and 208, wherein console 246 can be configured to operate one or more of the structural features and functions of rig apparatus 10.

Referring to FIGS. 17 to 20, rig apparatus 10 is shown in its transport configuration. In some embodiments, when moving rig apparatus 10 to drill or service a well, A-leg supports 64 can be disconnected from brackets 63 so that derrick mast 25 can be pivoted to a horizontal position wherein rack assemblies 32 can be disconnected at rack joint 35. Derrick pin 26 can then be removed so that upper mast section 22 can be folded towards lower mast section 20 wherein the mast sections are resting on headache rack 58. Cab 16 can be nested or telescoped together and moved to its transport position on the rear end of truck 11. Platform 19 can also be moved inwards onto the mast sections to place the platform in a transport position.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

The invention claimed is:

1. A rig apparatus for drilling or servicing a well, the apparatus comprising:

a) a substructure comprising a frame;

b) a derrick mast comprising a lower mast section pivotally attached to the frame and an upper mast section pivotally attached to the lower mast section, the derrick mast configured to move from a lowered substantially horizontal position relative to the frame, wherein the upper mast section is folded against the lower mast section, to a raised substantially vertical position relative to the frame, wherein the upper mast section is pivoted relative to the lower mast section until the upper and lower mast sections are substantially axially aligned to form the derrick mast;

c) a rack assembly disposed in the derrick mast, the rack assembly including a rack having an upper end and a lower end, the rack being hung by the upper end from an upper end of the derrick mast and the rack being free to flex and move within the derrick mast;

d) a carriage assembly configured to travel up and down the derrick mast along the rack assembly, the carriage assembly further configured to receive a tool; and e) a hydraulic drive assembly configured to provide hydraulic power for the apparatus.

2. The apparatus as set forth in claim 1, wherein the rack assembly further comprises an upper rack section disposed in the upper mast section and a lower rack section disposed in the lower mast section, the upper and lower rack sections configured for coupling to each other when the derrick mast is in the substantially vertical position.

3. The apparatus as set forth in claim 1, further comprising a first load cell operatively disposed between the upper end of the rack assembly and the upper end of the derrick mast, the load cell configured to measure pull force.

4. The apparatus as set forth in claim 1, further comprising a first hydraulic cylinder for pivotally raising and lowering the lower mast section relative to the frame.

5. The apparatus as set forth in claim 1, further comprising at least one second hydraulic cylinder for pivoting the upper mast section relative to the lower mast section.

6. The apparatus as set forth in claim 1, wherein the carriage assembly further comprises a plurality of trolley wheels configured to travel along tracks or guides disposed along the upper and lower mast sections.

7. The apparatus as set forth in claim 1, wherein the carriage assembly further comprises a plurality of pinion motors configured to engage the rack assembly wherein operation of the pinion motors cause the carriage assembly to travel along the rack assembly.

8. The apparatus as set forth in claim 7, wherein the pinion motors are disposed on the carriage assembly in two vertical columns and configured to engage the rack assembly on opposing sides of the rack assembly.

9. The apparatus as set forth in claim 8, wherein each pinion motor comprises a pinion gear and each opposing side of the rack assembly comprises teeth disposed thereon, the teeth configured to engage the pinion gears.

10. The apparatus as set forth in claim 1, wherein the tool comprises at least one of a group consisting of a top drive, a power swivel, a coil tubing injector, a continuous rod injector, a pipe gripper, push slips, a wobble drive, a rotating pipe handler, links and elevators.

11. The apparatus as set forth in claim 1, wherein the hydraulic drive assembly further comprises a hydraulic drive motor, a hydraulic fluid pump, a hydraulic tank, a supply of hydraulic fluid and at least one hydraulic fluid control valve for controlling the flow of hydraulic fluid.

12. The apparatus as set forth in claim 1, further comprising a mud pump system, further comprising a mud pump, a mud pump motor and a mud pump manifold.

13. The apparatus as set forth in claim 1, further comprising a programmable logic controller configured to control the hydraulic drive assembly.

14. The apparatus as set forth in claim 1, further comprising at least one tugger winch disposed on a crown disposed on the upper mast section.

15. The apparatus as set forth in claim 1, wherein the substructure further comprises one or both of a motor vehicle and a rig mat.

16. A method for drilling or servicing a well, the method comprising the steps of:

a) providing a rig apparatus, the apparatus comprising:

i) a substructure comprising a frame, ii) a derrick mast comprising a lower mast section pivotally attached to the frame and an upper mast section pivotally attached to the lower mast section, the derrick mast configured to move from a lowered substantially horizontal position relative to the frame, wherein the upper mast section is folded against the lower mast section, to a raised substantially vertical position relative to the frame, wherein the upper mast section is pivoted relative to the lower mast section until the upper and lower mast sections are substantially axially aligned to form the derrick mast, iii) a rack assembly disposed in the derrick mast, the rack assembly including a rack having an upper end and a lower end, the rack being hung by the upper end from an upper end of the derrick mast and the rack being free to flex and move within the derrick mast;

iv) a carriage assembly configured to travel up and down the derrick mast along the rack assembly, the carriage assembly further configured to receive a tool, and v) a hydraulic drive assembly configured to provide hydraulic power for the apparatus;

b) moving the apparatus to a position adjacent to the well;

c) raising the derrick mast to the substantially vertical position;

d) placing the tool on the carriage assembly;

e) operating the carriage assembly to engage and ride along the rack assembly, while the rack self-aligns, flexes and moves while passing through the carriage assembly; and f) drilling or servicing the well.

17. The method as set forth in claim 16, wherein the rack assembly further comprises an upper rack section disposed in the upper mast section and a lower rack section disposed in the lower mast section, the upper and lower rack sections configured for coupling to each other when the derrick mast is in the substantially vertical position.

18. The method as set forth in claim 16, wherein the step of raising the derrick mast to the substantially vertical position further comprises the steps of:

a) first raising the lower mast section from the substantially horizontal position to the substantially vertical position, wherein the upper mast section is folded against the lower mast section; and b) then pivoting the upper mast section relative to the lower mast section until the upper and lower mast sections are substantially axially aligned to form the derrick mast.

19. The method as set forth in claim 16, wherein the apparatus further comprises a first load cell operatively disposed between the upper end of the rack and the upper end of the derrick mast, and the method further comprising measuring pull force at the load cell.

20. The method as set forth in claim 16, wherein the apparatus further comprises a first hydraulic cylinder for pivotally raising and lowering the lower mast section relative to the frame.

21. The method as set forth in claim 16, wherein the apparatus further comprises at least one second hydraulic cylinder for pivoting the upper mast section relative to the lower mast section.

22. The method as set forth in claim 16, wherein the carriage assembly further comprises a plurality of trolley wheels configured to travel along tracks or guides disposed along the upper and lower mast sections.

23. The method as set forth in claim 16, wherein the carriage assembly further comprises a plurality of pinion motors configured to engage the rack assembly wherein operation of the pinion motors cause the carriage assembly to travel along the rack assembly.

24. The method as set forth in claim 23 wherein the pinion motors are disposed on the carriage assembly in two vertical columns and configured to engage the rack assembly on opposing sides of the rack assembly.

25. The method as set forth in claim 24, wherein each pinion motor comprises a pinion gear and each opposing side of the rack assembly comprises teeth disposed thereon, the teeth configured to engage the pinion gears.

26. The method as set forth in claim 16, wherein the tool comprises at least one of a group consisting of a top drive, a power swivel, a coil tubing injector, a continuous rod injector, a pipe gripper, push slips, a wobble drive, a rotating pipe handler, links and elevators.

27. The method as set forth in claim 16, wherein the hydraulic drive assembly further comprises a hydraulic drive motor, a hydraulic fluid pump, a hydraulic tank, a supply of hydraulic fluid and at least one hydraulic fluid control valve for controlling the flow of hydraulic fluid.

28. The method as set forth in claim 16, wherein the apparatus further comprises a mud pump system, further comprising a mud pump, a mud pump motor and a mud pump manifold.

29. The method as set forth in claim 16, wherein the apparatus further comprises a programmable logic controller configured to control the hydraulic drive assembly.

30. The method as set forth in claim 16, wherein the apparatus further comprises at least one tugger winch disposed on a crown disposed on the upper mast section.

31. The method as set forth in claim 16, wherein the substructure further comprises one or both of a motor vehicle and a rig mat.

32. A rig apparatus for drilling or servicing a well, the apparatus comprising:

a) a substructure comprising a frame with a front end, a rear end and a first side and a second side extending between the front end and the rear end; and b) a derrick mast comprising:

a lower mast section with a base end and an upper end, the base end pivotally attached to the frame; and an upper mast section pivotally attached to the upper end of the lower mast section, the upper mast section being pivotally attached to the upper end of the lower mast section by a pivotal connection including:

a hinge between the upper end of the lower mast section and a lower end of the upper mast section, the hinge configured to permit the upper section to move from a position folded against the lower section to the raised substantially vertical position, wherein the upper mast section rests on top of, and extends in axial alignment, with the lower mast section;

a pivot bar pivotally attached to hinge at one end and having a pivot bracket at the other end; and, jack knife hydraulic cylinders pivotally attached to pivot bracket at one end and pivotally attached to the upper mast section and the lower mast section respectively, the jack knife hydraulic cylinders configured to rotate the upper mast section relative to the lower mast section about the hinge, and the derrick mast configured to move between a lowered position and a raised substantially vertical position relative to the frame, wherein in the lowered position, the lower mast section is in a substantially horizontal position relative to the frame and the lower mast section extends along a length of the frame on the first side and the upper mast section is folded beside the lower mast section and is extending along the second side.

33. The rig apparatus of claim 32 wherein the lower mast section is pivotally attached to the frame at a corner between the rear end and the first side such that the derrick mast in the raised substantially vertical position extends up from the corner.

34. The rig apparatus of claim 32 further comprising a top drive connected to a carriage assembly and the carriage assembly is coupled to the derrick mast and wherein in the lowered position, the carriage assembly is coupled to and positioned above the lower mast section.

35. The rig apparatus of claim 32, further comprising a rack assembly in the mast, the rack assembly including an upper rack section disposed in the upper mast section and a lower rack section disposed in the lower mast section, the upper and lower rack sections being disconnected from each other when the mast is in the lowered position and connected to each other when the derrick mast is in the raised substantially vertical position and wherein when the upper and lower rack sections are connected to each other, the rack assembly defines a linear gear along which a carriage assembly can engage and ride to move vertically up and down along both the upper mast section and the lower mast section of the derrick mast.

36. The rig apparatus of claim 32, wherein the frame further comprises a headache rack at the front end and wherein in the lowered position, both the lower mast section and the upper mast section rest on the headache rack.

37. A rig apparatus for drilling or servicing a well, the apparatus comprising:

a) a substructure;

b) a derrick mast mounted on the substructure and comprising a first derrick track and a second derrick track spaced from the first derrick track, the first and the second derrick tracks extending along a length of the derrick mast and secured along a first side and a second side, respectively of the derrick mast;

c) a rack assembly supported in, and extending along, the derrick mast and positioned between the first derrick track and the second derrick track; and d) a carriage assembly configured for self-propelled travel up and down the derrick mast, the carriage assembly including at least one pinion motor configured to engage and ride along the rack assembly and a plurality of trolley wheels configured to roll along the first and the second derrick tracks while the at least one pinion motor engages and rides along the rack assembly.

38. The rig apparatus of claim 37, wherein the rack assembly is coupled to the derrick mast only at an uppermost end and at a lowermost end to thereby be moveable within the derrick mast as carriage assembly follows the first and the second derrick tracks.

39. The rig apparatus of claim 37, wherein the carriage assembly further includes rollers positioned to ride along side surfaces of the rack assembly and configured to guide the rack assembly through the carriage assembly.

40. The rig apparatus of claim 37, wherein the at least one pinion motor includes a motor, a pinion gear driven by the motor and a backlash wheel, the backlash wheel configured to ride along a side surface of the rack assembly to maintain a selected depth of engagement between the pinion gear and the rack assembly.

41. The rig apparatus of claim 40, wherein the rack assembly includes an elongate shoulder and teeth protruding out beyond the elongate shoulder and the backlash wheel is configured to ride along the elongate shoulder while the pinion gear engages the teeth.

42. The rig apparatus of claim 41, wherein the rack assembly includes a plurality of toothed rack sections sandwiched between a plate and the elongate shoulder is an edge surface of the plate.

* * * * *